US009409078B2

(12) United States Patent
Copeland et al.

(10) Patent No.: US 9,409,078 B2
(45) Date of Patent: Aug. 9, 2016

(54) SPORTS GLOVE WITH 3-DIMENSIONAL FINGER PORTION

(75) Inventors: Steve A. Copeland, Barrie (CA); Alexander P. Reynolds, Wayland, MA (US)

(73) Assignee: adidas, AG, Herzogenaurach (DE)

( * ) Notice: Subject to any disclaimer, the term of this patent is extended or adjusted under 35 U.S.C. 154(b) by 522 days.

(21) Appl. No.: 12/956,862

(22) Filed: Nov. 30, 2010

(65) Prior Publication Data

US 2012/0131714 A1 May 31, 2012

(51) Int. Cl.
*A63B 71/00* (2006.01)
*A63B 71/14* (2006.01)

(52) U.S. Cl.
CPC ..... *A63B 71/143* (2013.01); *A63B 2102/14* (2015.10)

(58) Field of Classification Search
USPC ..... 2/16, 20, 161.1, 161.6, 163
See application file for complete search history.

(56) References Cited

U.S. PATENT DOCUMENTS 3,273,165 A * 9/1966 Sperandeo ..... 2/169
3,606,614 A * 9/1971 Dimitroff ..... 2/159
3,643,386 A * 2/1972 Grzyll ..... 451/523
4,094,014 A * 6/1978 Schroeder ..... 2/161.8
4,164,043 A * 8/1979 Fujita ..... 2/161.1
4,815,147 A * 3/1989 Gazzano et al. ..... 2/161.1
5,488,739 A * 2/1996 Cardinal ..... 2/161.1
5,787,506 A * 8/1998 Wilder et al. ..... 2/161.1
6,427,249 B1 * 8/2002 Mattesky ..... A41D 19/01505 2/161.6
D468,074 S * 1/2003 Votel ..... D2/619
6,550,069 B1 4/2003 Morrow
6,799,333 B2 10/2004 Morrow et al.
6,813,780 B2 * 11/2004 Morrow ..... 2/161.1
6,829,881 B1 * 12/2004 Manten ..... 57/243
6,990,690 B2 1/2006 Gait
7,117,540 B2 * 10/2006 Morrow ..... 2/161.1
7,318,241 B2 1/2008 Morrow
7,370,373 B2 5/2008 Kohler
7,530,120 B2 * 5/2009 Morrow et al. ..... 2/161.1
7,536,730 B2 * 5/2009 Estrella ..... A41D 19/00 2/159
7,562,398 B2 * 7/2009 Beland et al. ..... 2/161.1
7,836,521 B2 * 11/2010 Winningham ..... 2/161.1
2004/0123372 A1 * 7/2004 Kleinert ..... 2/161.1
2008/0263738 A1 * 10/2008 Shamis et al. ..... 2/16
2009/0019618 A1 * 1/2009 Winningham ..... 2/161.1
2009/0025120 A1 * 1/2009 Vestling ..... 2/161.1

* cited by examiner

*Primary Examiner* — Richale Quinn
(74) *Attorney, Agent, or Firm* — Sterne, Kessler, Goldstein & Fox P.L.L.C.

(57) ABSTRACT

A glove having a hand portion including a palmer region and a dorsal region with a finger portion and a thumb portion extending outwardly from the hand portion. The finger portion includes a first finger member for receiving a finger therein. The first finger member has a dorsal portion, an inner portion and a pair of sidewalls extending therebetween. A pair of seams join the dorsal and inner portions to the sidewalls and the seams are recessed inwardly so as to fall along the sides of an athlete's fingers when the glove is worn. The dorsal portion includes a plurality of protective pads, the inner portion includes one or more frictionally engaging surfaces; and the sidewalls permit air to flow into the finger cavity.

34 Claims, 13 Drawing Sheets

10
16b
68
16c
52a
52b
52b
68
52b
16a
52a
52a
52
68
72
16d
52b
52a
52a
72
52b
82
78
52b
56a
52b
56b
72
16
86
72
52b
76
38a
36
132
38
10a
84
38a
82
42
18
44
14
80
132
84
38b
82
46
10b
50
14a
74
48
114a
118
34
114c
40
W
26
114
98d
94b
22
94
104
102
114e
108
114b
102
98
98g
20
98a
102
108
110
134

98c
98e
W

SPORTS GLOVE WITH 3-DIMENSIONAL FINGER PORTION

BACKGROUND OF THE INVENTION

1. Technical Field

This invention relates generally to gloves. More particularly, the invention relates to protective sports gloves. Specifically, the invention relates to a sports glove that has finger members that each include a dorsal portion having a plurality of protective pads, an inner portion having one or more frictionally engaging surfaces; and sidewalls extending between the dorsal and inner portions that permit air to flow into the finger cavity. The dorsal and inner portions are connected to the sidewalls by spaced-apart seams that are situated within the interior of the finger cavity of the finger member and are positioned to fall inwardly away from the front and rear surfaces of the glove and along the sides of the athlete's fingers.

2. Background Information

There are a number of protective sports gloves currently used in high contact sports such as lacrosse and ice hockey. These gloves include a variety of features that aid in protecting the player's hands from impact during the game. Yet other features aid in making the gloves more comfortable for the player, such as through the provision of mechanisms for encouraging air circulation into the interior of the glove. Further features include specific solutions for strengthening the glove in certain areas to provide needed protection for specific parts of the player's hand, such as the thumb.

U.S. Pat. No. 6,550,069 to Morrow, for example, discloses a glove having a single wrist guard elastically coupled to the back portion. The wrist guard is a relatively narrow strip of protective padding at the base of the back of the glove. The strip is substantially uniform in width and therefore likely provides little additional protection to the wrist bones during active play. The glove also includes a number of vent holes in the back portion and mesh fabric in the palm portion to enhance air circulation in the interior of the glove.

U.S. Pat. No. 6,799,333 to Morrow et al discloses a glove for a lacrosse goalie that includes a cuff portion connected to a hand portion and a wrist guard that overlays a portion of the cuff. The glove also includes a flange that extends along one side. In this instance, the wrist guard is a relatively wide component that is suitable for a goalie as it provides adequate coverage of the wrist and forearm and therefore will protect the goalie's hand from impacts from balls and sticks. However, the size and shape of the wrist guard would substantially limit the range of motion a player's hand could go through and the glove would therefore be of little use to a player other than the goalie.

U.S. Pat. No. 6,813,780 to Morrow is a continuation of U.S. Pat. No. 6,550,069 and discloses a glove that includes the relatively narrow wrist guard that overlays a small area of the cuff portion, and includes the plurality of vents in the back portion of the glove. The glove also includes at least two flex lines to improve the mobility of the same. A first flex line runs horizontally across the glove. A second flex line runs across the glove at an angle to the horizontal. The vents in the back portion of the glove are disposed along one of the first and second flex lines.

U.S. Pat. No. 6,990,690 to Gait is directed to a glove that includes protective pads on the back of the glove, the fingers and the thumb portions. A cuff extends downwardly from the hand portion in a number of sections that run substantially aligned with the longitudinal axis of the glove. The cuff sections are disposed adjacent each other and do not overlap each other. The cuff sections are joined to each other and are somewhat pivotable relative to each other. Additionally, the cuff sections flare outwardly so that the range of motion of the player's hand is less restricted. A wrist guard is provided along an innermost edge of the cuff portion and is fixedly secured to the hand portion. The bottom edge of the wrist guard is contoured in an attempt to reduce the impact the fixed wrist guard will have on the motion of the player's hand.

U.S. Pat. No. 7,117,540 to Morrow is a continuation of U.S. Pat. No. 6,813,780 and discloses the same glove as discussed above. This patent also discloses a palm portion that is composed primarily of a durable material and includes a plurality of openings into the interior of the glove. At least one of the openings has a breathable material disposed therein.

U.S. Pat. No. 7,318,241 to Morrow is a continuation of U.S. Pat. No. 7,117,540 and additionally discloses that the glove has a palm portion made of two materials where at least one of the materials is designed to prevent bunching when the hand is flexed. The first material is a durable material and the second material is mesh.

U.S. Pat. No. 7,370,373 to Kohler discloses a glove that includes an elastic substrate that is used to secure protective pads together on those areas of a glove that typically include such pads, i.e., areas of the glove that are intended to cover a forearm, a wrist, a back of a hand, and finger and/or a thumb of the player. The elastic substrate is independently attached to different pad segments. Thus, when the player grasps a stick, for example, certain padded areas of the glove come under tension, and, in these areas, the substrate expands allowing the pads to move away from each other to a certain degree. When the player relaxes his hands, the elastic substrate allows the pads to move somewhat toward each other. Thus, the substrate increases the flexibility and mobility of the glove.

U.S. Publication No. 2009/0019618 to Winningham discloses a protective glove that includes a single, relatively broad wrist guard positioned over the dorsal region of the glove, specifically over the junction of the hand portion and cuff member. The wrist guard includes a contoured first edge facing toward the thumb and finger members and a second edge facing the edge of the cuff. The first edge may include a curvilinear portion where the first edge transitions from the dorsal region to the radial side of the glove.

Although all of these previously known gloves suit the purposes for which they were developed, there is always a need in the art for improvements to the same.

BRIEF SUMMARY OF THE INVENTION

The device of the present invention is a protective glove having a hand portion made up from a palmer region and a dorsal region which surround and define a cavity for receiving a player's hand. A finger portion and a thumb portion extend outwardly from the hand portion and a cuff portion is joined to the hand portion along a junction and extends outwardly from the hand portion in a direction opposite the finger portion. A wrist guard is disposed proximate the junction and is attached to the hand portion. The wrist guard is made up from a primary member and a secondary member. The primary member is attached to the hand portion and is disposed adjacent an area of the dorsal region proximate the junction. The type of attachment permits the primary member to pivot relative to the dorsal region. The secondary member is attached to the primary member and is free of attachments to both the hand portion and the cuff member. The secondary member is positioned so that it extends at least partially over the cuff portion. The attachment between the primary and secondary members is such that the secondary member is able to pivot relative to the primary member. Both of the primary and secondary members are also slidable along an exterior surface of the dorsal region and cuff portion of the glove. Thus, the wrist guard is an articulating protective member that is able to provide additional protection to the player's wrist and forearm as they flex and rotate their hand during play.

An object of the present invention is to provide a glove having a palm portion that is comprised of three different materials that impart different properties to the glove. The majority of the palm region is made from a first material with a high coefficient of friction that aids the player in gripping the handle of a sporting implement. The first material also aids in reducing the tendency of the handle to rotate within the grip of the player during play. The second material is one that is breathable and encourages circulation of air into the interior cavity of the glove. The third material is an elastic fabric that permits the palm region to expand in width when the glove is pulled on or taken off but reverts to its original width when the glove is seated around the hand, thus keeping the glove snug on the player's hand. The elastic fabric may comprise a cuff at the base of the palmer region and a relatively small insert that is continuous with the cuff. Alternatively the elastic fabric may constitute the previously identified areas and a further region that covers approximately half of the palmer region and under lays the first fabric in that addition region. In a third embodiment, the elastic fabric under lays substantially all of the second fabric in addition to being provided in the cuff and in the small insert.

A further object of the present invention is to provide a glove having a protective thumb crotch disposed on the dorsal region and intermediate the thumb portion and finger portion. The thumb crotch includes a side wall and a top wall and incorporates a pad made from a shock absorbent material. The side wall is disposed on the dorsal region and the top wall extends between the finger and thumb portions. Both the side wall and top wall of the thumb crotch are covered with the same first material used on the palmer region. The top wall is arcuate and cradles the handle of the sporting implement and the first fabric thereon reduces the tendency of the handle to rotate in the player's hand during play.

It is a further object of the present invention to provide a glove in which each of the finger members in the finger portion is 3-dimensional in shape. Each finger member includes a dorsal portion, an inner portion and a pair of sidewalls extending therebetween. A pair of seams join the dorsal and inner portions to the sidewalls and the seams are recessed inwardly so as to fall along the sides of an athlete's fingers when the glove is worn. Thus, none of the seams fall on the palmer surface of the glove. The dorsal portion includes a plurality of protective pads, the inner portion includes one or more frictionally engaging surfaces; and the sidewalls permit air to flow into the finger cavity. When viewed from the tip, the dorsal portion of each finger member is substantially straight. The side walls are substantially straight and disposed at right angles to the dorsal portion, and the inner portion is arcuate in shape.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DESCRIPTION OF THE PREFERRED EMBODIMENTS

Figure 1:
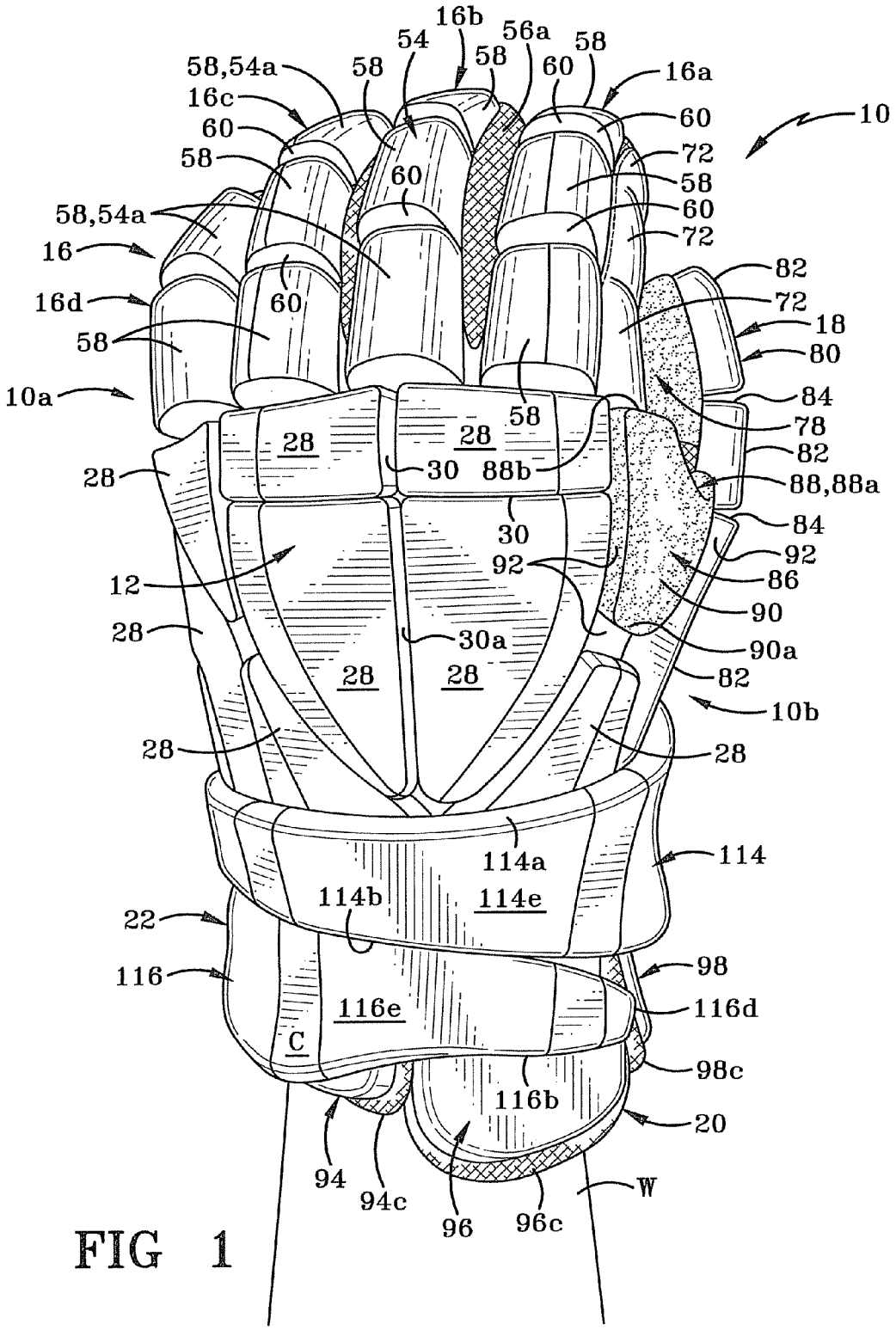
FIG. 1 is rear view of a glove in accordance with the present invention; with the glove shown being for a player's left hand.

At the outset, it should be appreciated that like drawing numbers on different drawing views identify identical, or functionally similar, structural elements of the invention. While the present invention is described with respect to what is presently considered to be the preferred embodiments, it is to be understood that the invention as claimed is not limited to the disclosed aspects.

Unless defined otherwise, all technical and scientific terms used herein have the same meaning as commonly understood to one of the ordinary skill in the art to which this invention belongs. Although any methods, devices or materials similar or equivalent to those described herein can be used in the practice or testing of the invention, the preferred methods, devices, and materials are now described.

Referring to FIGS. 1-15, there is shown a glove in accordance with the present invention, generally indicated at 10. As is evident from the figures, glove 10 is designed to be worn on the left hand of a player. The glove for the right hand will be a mirror image of the one illustrated herein. For the purposes of this description only, the left hand side of the glove is referred to by the character 10*a* and the right hand side of the glove is referred to by the character 10*b*.

Glove 10 includes a hand portion comprising a dorsal region 12, a palmer region 14 (FIG. 3), a finger portion 16, a thumb portion 18, a cuff portion 20, and a wrist guard 22. Glove 10 has a longitudinal axis "Y". Dorsal and palmer regions 12, 14 are joined to each other along their longitudinally aligned sides and they define a cavity 24 (FIG. 7) therebetween. Dorsal and palmer regions 12, 14 each have a first edge and a second edge that are disposed generally at right angles to longitudinal axis "Y". Finger portion 16 extends outwardly from the upper edges (not numbered) of dorsal and palmer regions 12, 14. The lower edges thereof, 12*a* (FIG. 6) and 14*a* (FIG. 3), are disposed remote from finger portion 16 and define an opening 26 (FIG. 3) into cavity 24. The player will insert their hand "H" (FIG. 7) into cavity 24 in hand portion through opening 26 and will likewise remove their hand therefrom. When hand "H" is inserted therein, the back of the player's hand will be disposed adjacent dorsal region 12 and the palm or front of the player's hand will be disposed adjacent palmer region 14. The player's wrist and forearm "W' will extend outwardly from opening 26.

Figure 7:
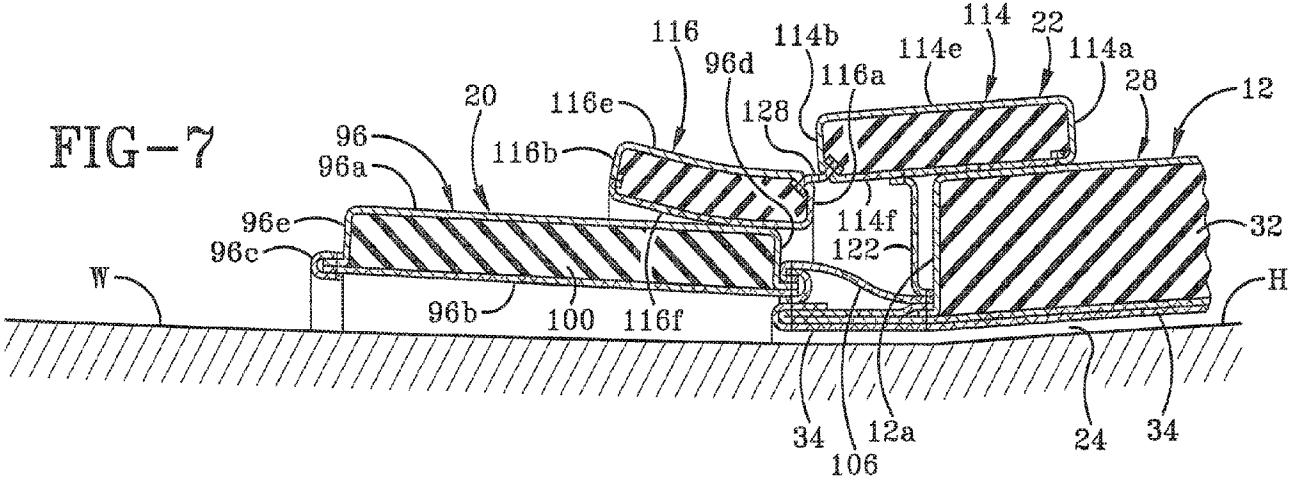
FIG. 7 is a cross-sectional right side view of the bottom end of the glove taken through line 7-7 of FIG. 5, showing the wrist guard and cuff in an at-rest position.
Figure 8:
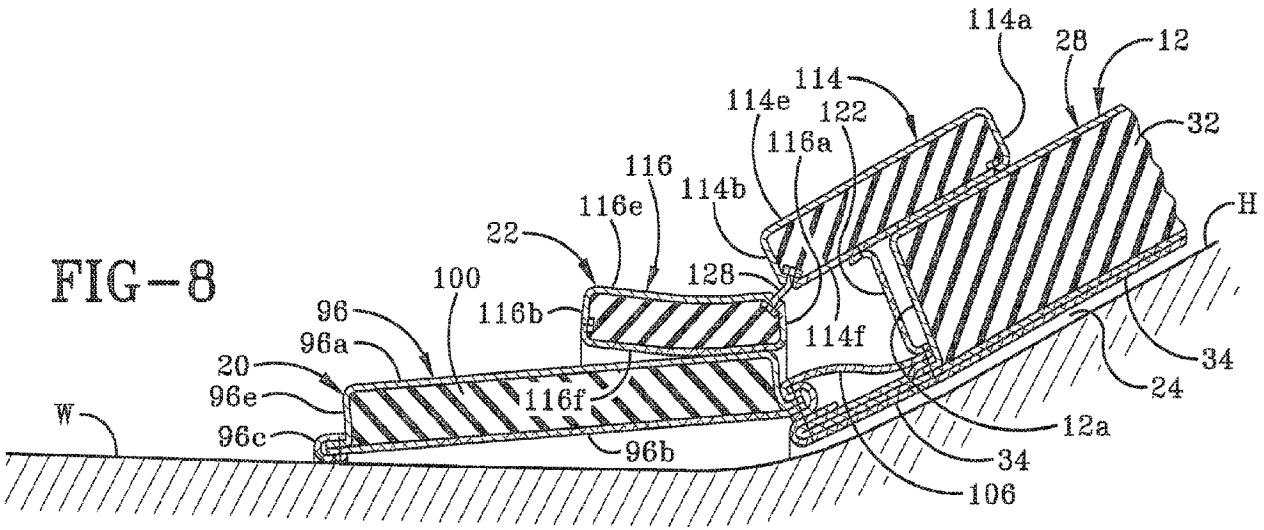
FIG. 8 is a cross-sectional right side view of the bottom end of the glove taken through line 7-7 of FIG. 5, showing the glove in a flexed position.

As shown in FIGS. 1 and 7, dorsal region 12 comprises a plurality of protective pads 28 that are separated from each other by valleys 30. Each pad 28 preferably comprises a pocket formed one or more layers or pieces of a leather, composite leather, vinyl or some other durable material. Each pocket surrounds and retains a shock absorbent material 32 therein (FIG. 7), such as a compressed foam material. Preferably, adjacent pockets are stitched or otherwise secured together and the stitches fall in the valleys 30. In accordance with a feature of the present invention, the entire dorsal region 12 is substantially continuous and free of openings into cavity 24. The valleys 30 are substantially V-shaped channels that are able to open and close as the player moves their hand "H" within glove 10. Valleys 30 permit a greater degree of flexion and freedom for the player to move their hand "H" than would be the case if the valleys 30 were not present. The exact configuration of each pad 28 and valley 30 may be varied without departing from the spirit of the present invention.

Figure 6:
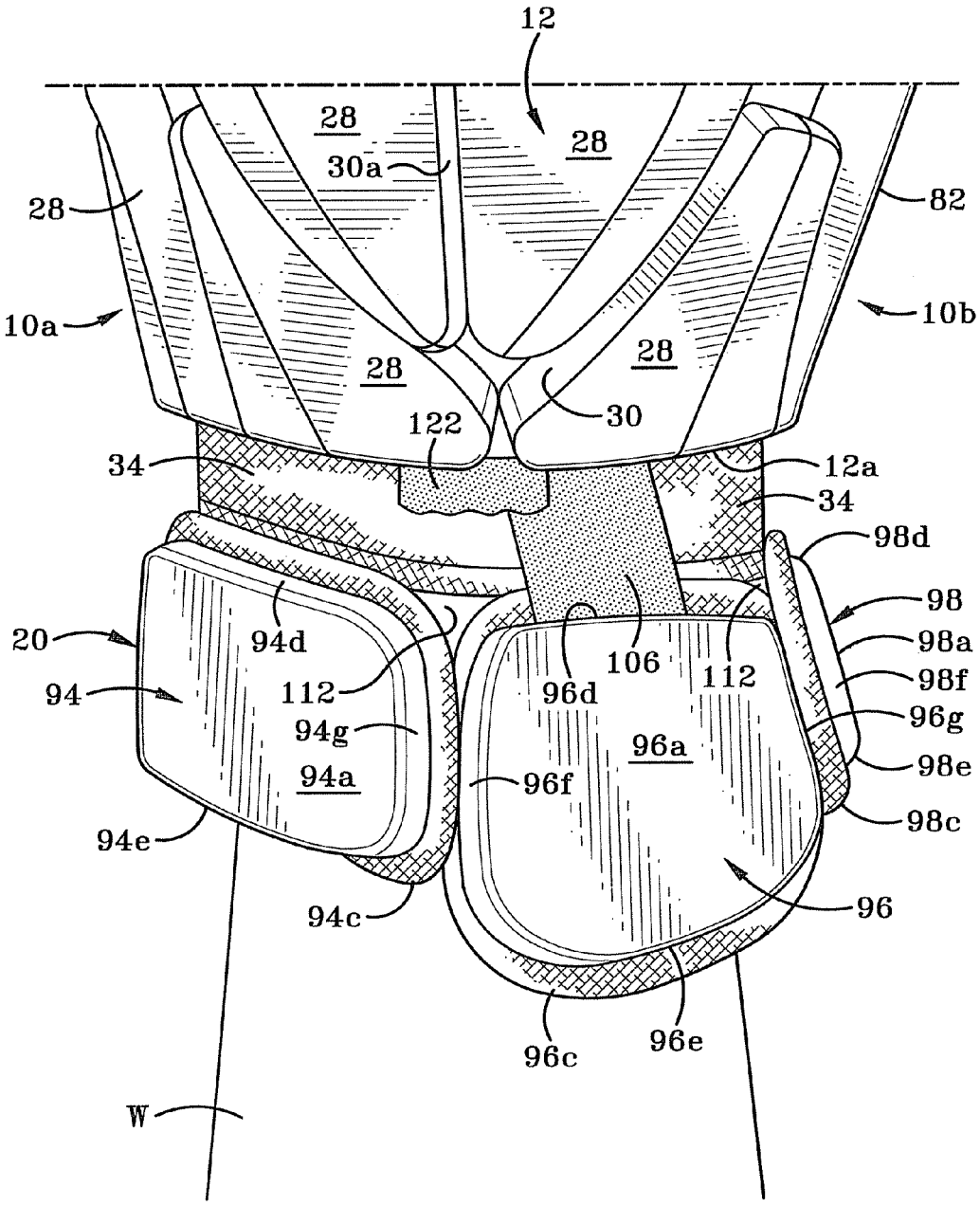
FIG. 6 is an enlarged rear view of the bottom end of the glove with the primary and secondary members of the wrist guard removed.

Dorsal region 12 further includes a liner 34 (FIGS. 6 & 7) that is disposed interiorly of pads 28 such that the player's hand "H" will contact liner 34. Liner 34 preferably is manufactured from a soft, preferably non-elastic material and is situated across substantially the entire dorsal region 12. As shown in FIG. 6, liner 34 extends for a distance downwardly beyond lower edge 12*a* of dorsal region 12. Liner 34 is secured to the material of the lowermost pads 28 adjacent lower edge 12*a* in a suitable manner, such as by stitches (FIG. 7). Liner 34 may additionally be fixedly or detachably secured to one or more pads 28 other than those positioned proximate lower edge 12*a*. Liner 34 thus effectively forms the interior surface of dorsal region 12. The portion of the liner 34 that extends beyond the lowermost pads disposed proximate second edge 12 will be situated adjacent a region of the player's wrist "W" when they are wearing glove 10.

The construction of dorsal region 12 is such that pads 28 are substantially fixed in position relative to each other and only move when the player flexes their hand "H" to the degree that the valleys 30 between adjacent pads are able to open and close. The shape and configuration of pads 28 and the placement of valleys 30 can be varied without departing from the spirit of the present invention. However, the configuration is one that allows for maneuverability of the dorsal region 12 as the player uses their hand. Additionally, the specific shape and placement of pads 28 and valleys 30 provides substantially equal protection for all regions on the back of the player's hand "H".

Figure 3:
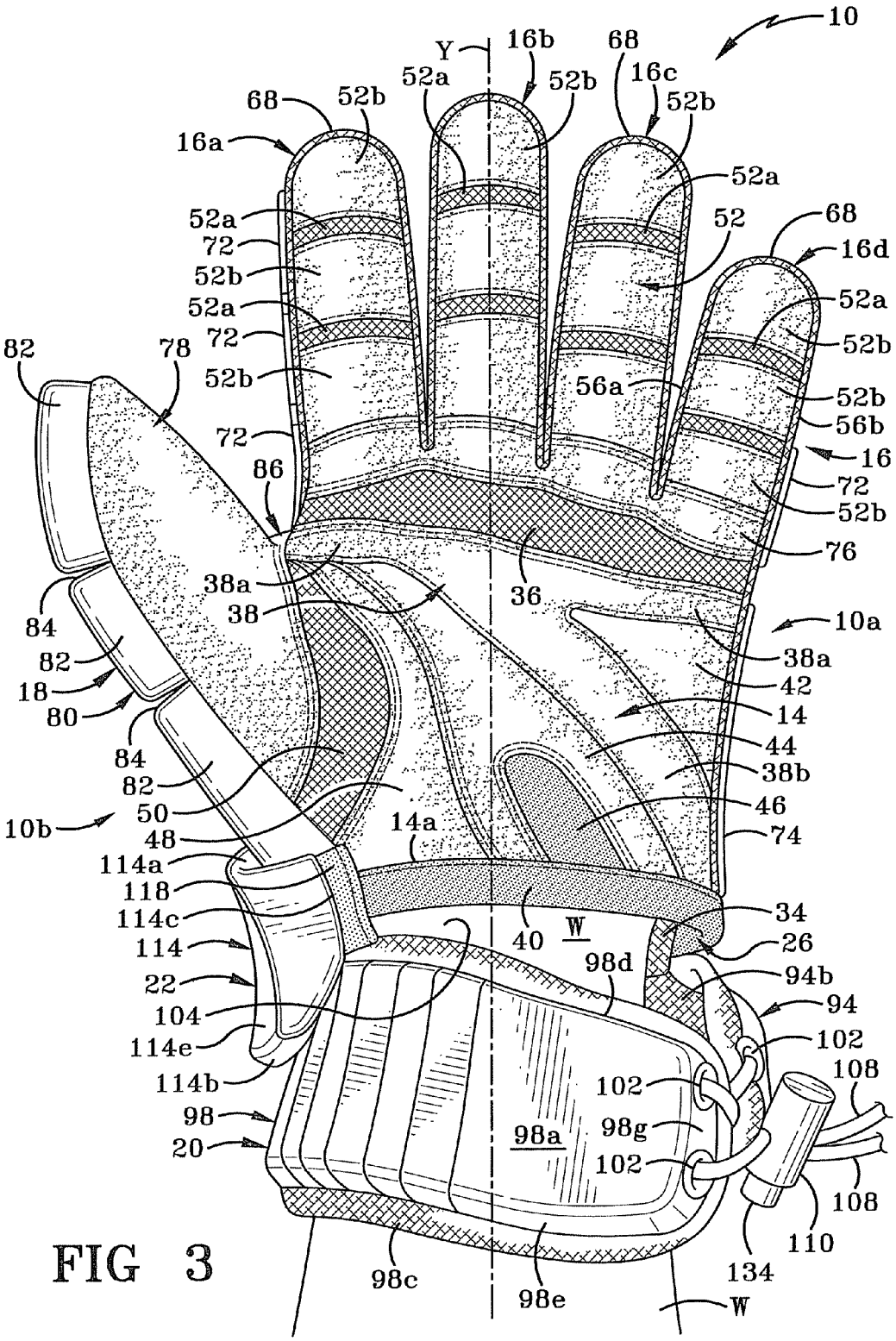
FIG. 3 is a front view of the glove.

A first embodiment of palmer region 14 is shown in FIG. 3. Palmer region 14 comprises a plurality of differently shaped areas that are secured to each other, preferably by stitching. Specifically, palmer region 14 comprises a first area 36 proximate finger portion 16. First area 36 preferably is substantially horizontally oriented with respect to the longitudinal axis "Y" of glove 10 and extends from the join between dorsal and palmer regions 12, 14 proximate first side 10*a* of glove 10 to the join between dorsal and palmer regions 12, 14 proximate second side 10*b* of glove 10. A second area 38 of palmer region 14 is substantially Y-shaped and includes a first leg 38*a* and a second leg 38*b*. First leg 38*a* is substantially horizontally oriented with respect to the longitudinal axis "Y" and is secured along one edge to first area 36. Second leg 38*b* is angled relative to first leg 38*a* and extends from proximate a middle region of first leg 38*a* angling downwardly toward a bottom corner of glove 10 proximate lower edge 14*a* of palmer region 14. Second leg 38*b* terminates at the lower edge 14*a* of palmer region 14. Preferably, a palmer cuff 40 is secured along the lower edge 14*a* of palmer region 14 and extends between thumb portion 18 and dorsal region 12. Palmer cuff 40 may be omitted and the lower edge 14*a* of palmer region 14 will then effectively partially bound the opening 26 to cavity 24. When provided, palmer cuff 40 effectively becomes the lower edge of palmer region 14 and at least partially bounds opening 26 to cavity 24. Palmer cuff 40 will be discussed further hereinafter. A generally triangular third area 42 is disposed between and is connected to first and second legs 38*a*, 38*b* of second area 38. Third area 42 terminates at the join between dorsal and palmer regions 12, 14 at the first side 10*a* of glove 10. Palmer region 14 further includes a generally Y-shaped fourth area 44 that comprises a first leg 44*a* and a second leg 44*b*. First leg 44*a* extends substantially diagonally across the palmer region 14 and is secured to a portion of first leg 38*a* and a portion of second leg 38*b* of second area 38. Both of first and second legs 44*a*, 44*b* of fourth area 44 extend downwardly toward lower edge 14*a* and terminate therein. First and second legs 44*a*, 44*b* are secured to palmer cuff 40. A fifth area 46, that is generally U-shaped, is secured between first and second legs 44*a*, 44*b* and to palmer cuff 40. The nature of fifth area 46 will be discussed further hereinafter. A sixth area 48 that is generally triangular in shape originates proximate the join between the dorsal and palmer regions 12, 14 at the second side 10*b* of glove 10 and terminates in palmer cuff 40. Sixth area 48 is secured to a portion of first leg 38*a* of second area 38 and is secured to a portion of first and second legs 44*a*, 44*b* of fourth area 44. Finally, a generally D-shaped seventh area 50 is provided between sixth area 48 and thumb portion 18. Seventh area 50 is secured at a top end to one or both of second and sixth areas 34, 44, is secured along to a portion of sixth area 48 and the remaining peripheral edges thereof are secured to thumb portion 18.

In accordance with one of the specific features of the present invention, palmer region 14 preferably is constructed from three distinct materials having three different properties. The first material is a breathable mesh material. This material is used in first area 36 and seventh area 50 and allows air to flow into and out of cavity 24 in hand portion. The second material is a microfiber material that is used in second area 38, third area 42, fourth area 44, and sixth area 48. The microfiber material is durable and has a high coefficient of friction. The coefficient of friction of the microfiber material is higher than that of the material used on dorsal region 12. The microfiber material enhances the gripping characteristics of glove 10 and aids in ensuring that the handle "S" (FIGS. 14 & 15) will not tend to slip and rotate within the glove when a shot is taken or a stroke is played.

The third material used in the construction of palmer region 14 is an elastic material. If palmer cuff 40 is not provided, then the lower edge 14*a* of palmer region will comprise portions of sixth area 48, fourth area 44, fifth area 46 and second area 38 and will extend from thumb portion 18 to dorsal region 12. The lower edge will join dorsal region 12 at the side 10*a* of glove 10. The lower edge 14*a* will have a length "L" measured between the connections to thumb portion 18 and dorsal region 12 when glove 10 is in a relaxed state and is not worn on a player's hand. In accordance with the present invention, fifth area 46 is made from the elastic material and is secured around its generally U-shaped peripheral edge to the rest of the areas that constitute an upper layer of palmer region 14. Thus, the lower edge 14*a* of palmer region 14 includes a wedge of elastic material and this makes the length "L" of the lower edge 14*a* adjustable. If palmer cuff 40 is secured to lower edge 14*a*, then palmer cuff 40 effectively becomes the lower edge of palmer region and has a length "L" when the glove is in the relaxed state. Palmer cuff 40 may be manufactured entirely from the elastic material, which is preferred, or may only include a section of elastic material along its length. In the latter instance, the elastic material on palmer cuff 40 should at least partially align with fifth area 46. Consequently, no matter which of the above-mentioned constructions employed in the lower edge of palmer region 14, the length "L" of that lower edge is adjustable because of the presence of the elastic material in one or both of fifth area 46 and palmer cuff 40. The coefficient of friction of the microfiber material is also higher than the coefficient of friction of the elastic material.

In the first embodiment of the invention shown in FIG. 3, the elastic material is only provided in fifth area 46 and palmer cuff 40 and does not extend for more than a very short distance beyond the boundaries of these two regions. The elastic material allows the width of glove 10, as measured from first side 10*a* to second side 10*b* thereof, to temporarily increase when the player's hand "H" is inserted through opening 26 and then to revert to its original width once the player's hand "H" is received in cavity 24. Furthermore, when hand "H" is withdrawn from cavity 24, the elastic material once again expands to permit hand "H" to be easily withdrawn from cavity 24. This expandable property of fifth area 46 and palmer cuff 40 ensures that glove 10 maintains a snug fit around hand "H" but still enables the player to easy put the glove on and take it off.

Figure 9:
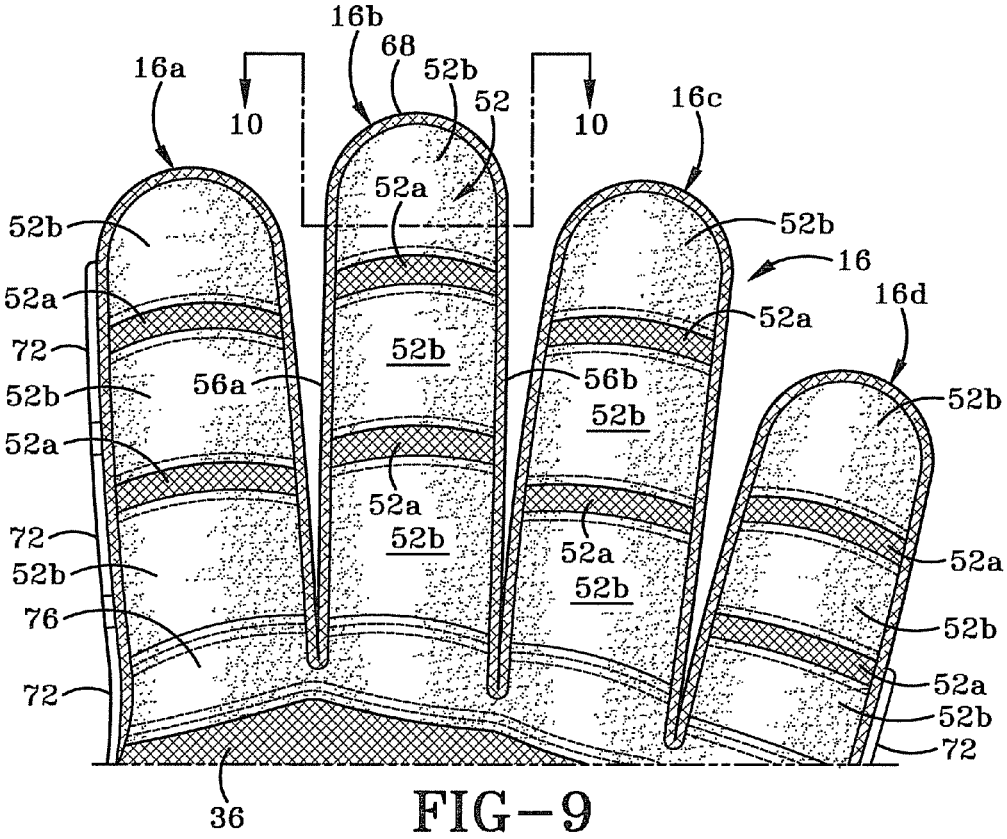
FIG. 9 is an enlarged front view of the finger portion of the glove.
Figure 10:
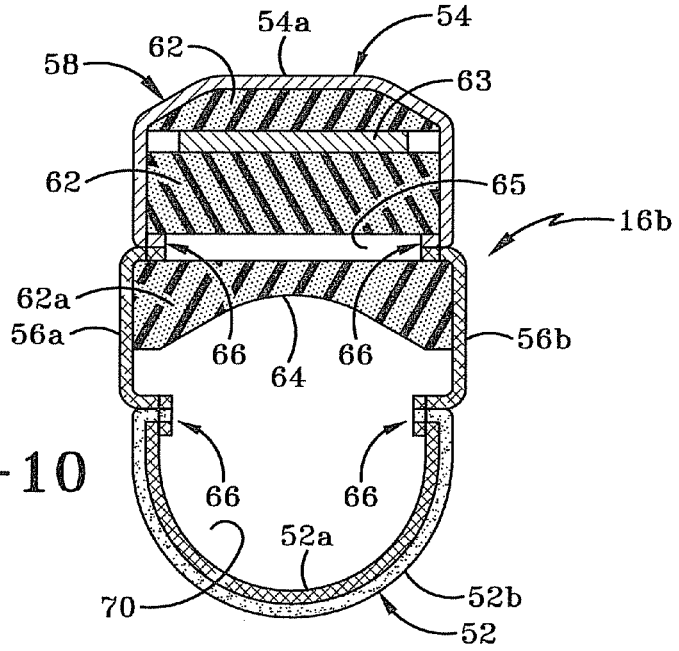
FIG. 10 is a cross-sectional top view of a single finger member taken through line 10-10 of FIG. 9.

Referring to FIGS. 1, 9 and 10, finger portion 16 comprises four finger members 16*a*-16*d* that extend outwardly from the first edges of dorsal and palmer regions 12, 14. Finger members 16*a*-16*d* are disposed generally aligned with longitudinal axis "Y" of glove 10. When the glove 10 is worn on hand "H", finger member 16*a* will receive the player's index finger therein, finger member 16*b* will receive the middle finger therein, finger member 16*c* will receive the ring finger therein, and finger member 16*d* will receive the little finger therein. Each finger member 16*a*-16*d* is substantially identical in construction. The following description references finger member 16*b* but applied equally to all four finger members.

Finger member 16*b* has an inner portion 52 (FIG. 10), a dorsal portion 54 and a pair of sidewalls 56*a*, 56*b* extending between inner and outer sides 52, 54. Inner and outer sides 52, 54 and sidewalls 56*a*, 56*b* surround and define a cavity 70 that is configured to receive the player's finger therein. Inner portion 52 will be disposed adjacent the front of the player's finger; dorsal portion 54 will be disposed adjacent the back of the player's finger, and sidewalls 56*a*, 56*b* will be disposed adjacent the sides of the players' finger.

Inner portion 52 preferably is made from an elongate piece of mesh material 52*a* onto which horizontal pieces of microfiber material 52*b* are stitched. (First area 36 may also be integral with the elongate lengths of mesh material used to form the inner portions 52 of the four finger members 16*a*-16*d*.) Alternatively, smaller pieces of mesh material and microfiber material could be stitched together to form the elongate inner portion 52 of finger member 16*b*. Mesh regions 52*a* preferably are located to fall adjacent the inner surfaces of the player's knuckles and microfiber regions 52*b* are located to fall adjacent the fleshy regions of the player's fingers.

Dorsal portion 54 is formed in much the same manner as dorsal region 12 of glove 10. Consequently, dorsal portion 54 is manufactured from one or more pieces of a durable material, such as leather, that are constructed into a plurality of pads 58 (FIG. 1) separated from each other by valleys 60. Preferably, dorsal portion 54 includes three pads 58 separated from each other by two valleys 60, where valleys 60 are disposed to fall adjacent the player's knuckles so that they can bend their fingers. (Finger member 16*d* includes only two pads 58 separated from each other by one valley 60.) Each pad 58 preferably includes a plurality of layers of shock absorbent material 62 that are spatially separated from each other. Layers 62 may be secured together by an adhesive layer 63 or may be separated from each other by a gap 65. The innermost layer 62*a* includes a curved inner surface 64 that is contoured to seat the back of the player's finger comfortably therein. The outermost surface 54*a* of dorsal portion 54 is generally planar and thus pad 58 presents a larger, flat contact surface to absorb blows to the fingers. Inner portion 52 is substantially arcuate in cross-sectional shape and extends arcuately away from the dorsal portion 54.

As indicated previously, sidewalls 56*a*, 56*b* extend between inner portion 52 and dorsal portion 54. Sidewalls 56*a*, 56*b* are made from breathable mesh material and preferably are integral with each other and form an arcuate tip 68 at the top of finger member 16*b*. Thus, tip 68 is also formed from the breathable mesh. Tip 68 is substantially arcuate when glove 10 is viewed from either of the front or back. Tip 68 has a semi-circular shape and inner portion 52 curves toward tip 68. Tip 68 further includes an arcuate tip that is generally perpendicular to the arcuate inner portion 52. Sidewalls 56*a*, 56*b* are substantially planar when the glove is in a relaxed state, such as in FIG. 3, and are generally perpendicular to outer surface 54*a* of dorsal portion 54. Finger member 16*b* further comprises a first radius between one of the pair of sidewalls 56*a*, 56*b* and inner portion 52 and a second radius between the other of the pair of sidewalls 56*a*, 56*b* and inner portion 52. Preferably, the first radius and the second radius are the same but they may differ from each other. Furthermore, the first radius and the second radius are continuous and form an angle of approximately 180 degrees.

FIG. 10 shows that the various materials, namely, the leather or vinyl that forms dorsal portion 54, the mesh that forms sidewalls 56*a*, 56*b* and mesh and microfiber that forms inner portion 52 are folded inwardly into the interior of the finger member and are secured together by stitching to form seams 66. Seams 66 are disposed within finger cavity 70 and may be reinforced to ensure that they do not accidentally break. Additionally, seams 66 are spaced a distance inwardly from each of the dorsal and palmer regions 12, 14 of glove 10.

The material of inner portion 52 therefore wraps partially around the sides of finger member and extends for a distance inwardly away from the front thereof. Similarly, the material of dorsal portion 54 warps partially around the sides of the finger member and extends for a distance inwardly away from the back thereof. Thus, the sides of each finger member include a first area comprised of the material that forms sidewalls 56*a*, 56*b*, a second area comprised of the material that forms inner portion 52, and a third area comprised of the material that forms dorsal portion 54. In accordance with another specific feature of the present invention, sidewalls 56*a*, 56*b* are spaced substantially the same distance away from dorsal and palmer regions 12, 14. Seams 66 are therefore located such that they will be positioned adjacent the sides of the athlete's fingers. Furthermore, the location of seams 66 is such that they will fall a distance inwardly away from the front and back surfaces of the athlete's fingers. Thus, the material used to form inner portion 52 wraps for a distance around the sides of each finger. Similarly, the material used to form dorsal portion 54 of each finger member wraps for a distance around the sides of each finger. This type of 3D construction moves seams 66 off the athlete's palmer side of the fingers thereby allowing for more uninterrupted palmer contact with the stick. This construction also makes glove 10 more comfortable to wear, makes it more aesthetically appealing from the outside and aids in keeping seams 66 secure as the stitches therein are not exposed on the exterior of glove and are therefore less at risk for breakage.

In accordance with another feature of the present invention, the exterior surfaces of sidewalls 56*a*, 56*b* on the outside edges of finger members 16*a* and 16*d* also include protective patches 72 (FIGS. 1, 2 & 4) to aid in protecting the player's fingers. Patches 72 preferably are formed from pieces of leather or other durable material that is stitched or otherwise secured over the outer surface of the breathable mesh of sidewalls 56*a*, 56*b*. A thin layer of a shock absorbent material may be disposed between each patch 72 and sidewall 56*a*, 56*b*.

In accordance with yet another feature of the present invention, an additional protective patch 74 may similarly be provided along the junction between the dorsal and palmer regions 12, 14 along side 10*a*. Protective patch 74 is constructed from a durable material, such as leather, and preferably also includes at least a thin layer of shock absorbent material. Patch 74 is provided to protect the side of the player's hand that extends downwardly from the little finger.

Glove 10 further includes a reinforcement member 76 that extends across the bases of one or more finger members 16*a*-16*d* and connects the same to first area 36 of palmer region 14. Preferably, reinforcement member 76 connects palmer region 14 and all of the finger members 16*a* through 16*d*. Reinforcement member 76 is comprised of the microfiber material.

Various seams between the pieces of material that are used to construct glove 10 may be double stitched to reinforce the same. Such double stitching is provided on all the seams in reinforcement member 76, on the seam joining first area 36 and second area 38 and the seam surrounding fifth area 46.

Figure 2:
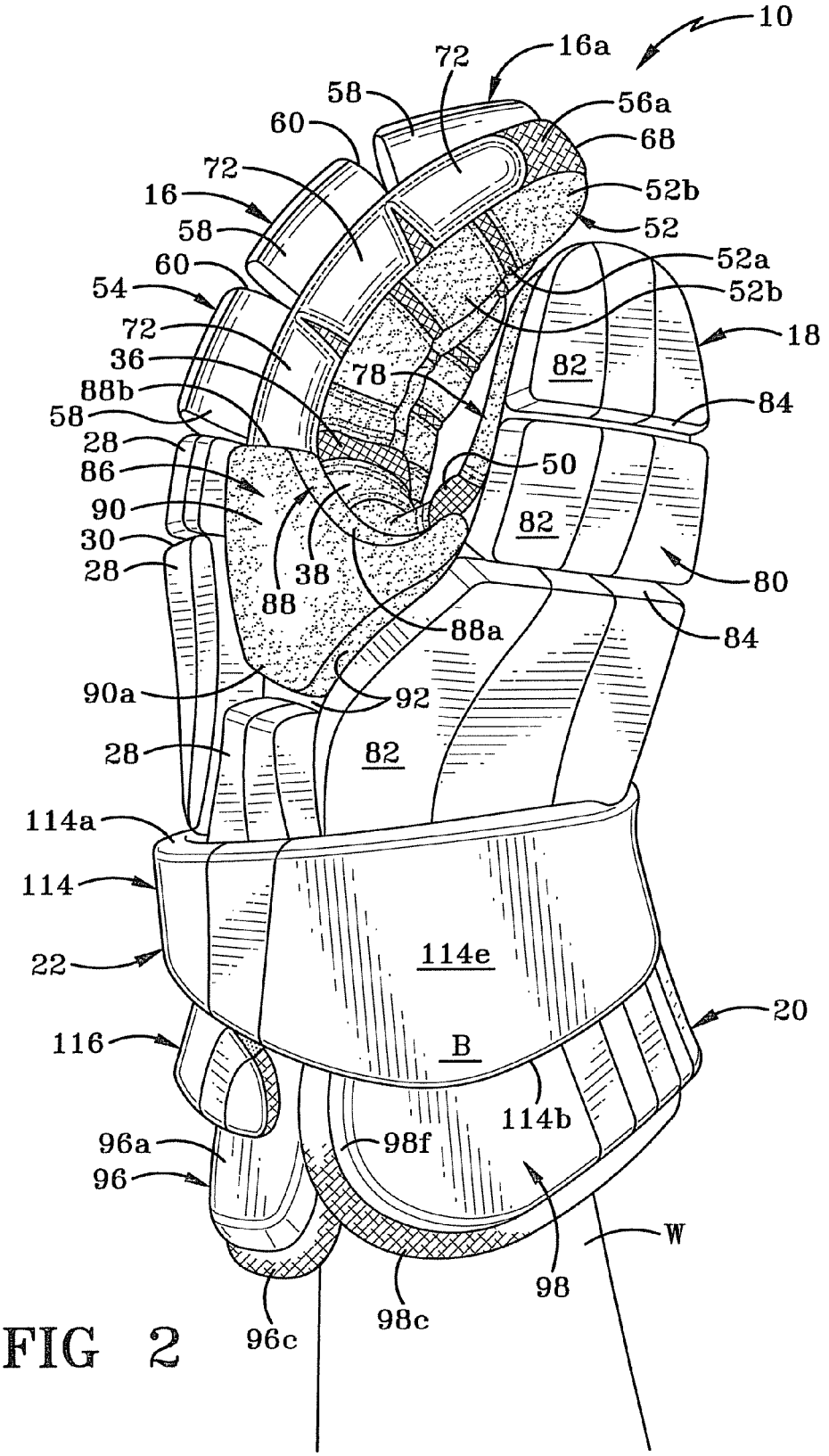
FIG. 2 is a right side view of the glove.

Referring to FIGS. 2 and 3, thumb portion 18 includes an inner portion 78 and a dorsal region 80 that are joined together along their edges to define and internal thumb cavity (not shown). The player's thumb is received in the thumb cavity such that the back of the thumb is adjacent the dorsal region 80 and the front of the thumb is adjacent the inner portion 78. Dorsal region 80 is constructed in a similar manner to dorsal region 12 and dorsal portion 54 of finger members 16*a*-16*d* and includes three pads 82 that are separated from each other by two valleys 84. Pads 82 are constructed from a durable material, such as leather, that is formed into a pocket which retains a shock absorbing material therein. Valleys 84 are disposed on thumb portion 18 in a location that will fall adjacent the player's knuckle and joint and the base of the thumb so that the thumb portion 18 will be able to be bent and flexed with relative ease. Inner portion 78 of thumb is manufactured from a piece of microfiber material and is joined, preferably by a double stitched seam, to the seventh area 50 of palmer region.

In accordance with a specific feature of the present invention, a thumb crotch 86 is provided in the area of the glove between thumb portion 18 and finger member 16*a*. Thumb crotch 86 is situated in such a location that when the glove is on the player's hand, the thumb crotch 86 protects the area of soft tissue that is disposed between the player's thumb and index finger. Thumb crotch is manufactured from the microfiber material which covers a crush-resistant, shock absorbing pad. Thumb crotch 86 extends downwardly into dorsal region 12, is generally triangular in shape, and includes a top wall 88 and sidewall 90. The materials that form dorsal region 12, finger portion 16 and thumb portion 18 are sewn so that valleys 92 separate thumb crotch 86 from pads 28, 58 and 82 on dorsal region 12, finger member 16*a* and thumb portion 18.

Thumb crotch 86 has an apex 90*a* disposed in a region that is about midway down the length of dorsal region 12 between the upper and lower edges. Apex 90*a* is disposed adjacent second side 10*b* of glove 10 and proximate a base of thumb portion 18. As such, apex 90*a* falls in a region that will be proximate the base of the player's thumb when the player's hand "H" is in the glove. Apex 90*a* is disposed opposite top wall 88. A first section 88*a* of top wall 88, which extends between finger member 16*a* and thumb portion 18, is concavely curved. Because of the crush-resistant pad present in thumb crotch 86, top wall 88 is semi-rigid to rigid. The curved first section 88*a* of top wall 88 has a radius that is axially aligned with the side wall 90. Furthermore, when stick "S" is held by the gloved hand of the player, it can be seen that the radius and shape of top wall 88 is substantially complementary to the shape and diameter of stick "S".

A second section 88*b* of top wall 88 is substantially planar and extends outwardly away from the curved section 88*a* and onto finger member 16*a*. Second section 88*b* is secured to finger member 16*a* in a location that will be disposed adjacent the base of an index finger of a player when glove 10 is worn. The width of the second section 88*b* is substantially equal to the width of sidewall 56 of finger member 16*a*. Second section 88*b* serves to anchor thumb crotch 86 on finger portion 16 and provides a braced region of thumb crotch 86 during play so that the upper portion of thumb crotch 86 is not accidentally ripped off dorsal region 12 during play. The part of thumb crotch 86 secured to sidewall 56 of finger member 16*a* ensures that the knuckle bone at the base of the index finger is well protected from impacts.

Figure 15:
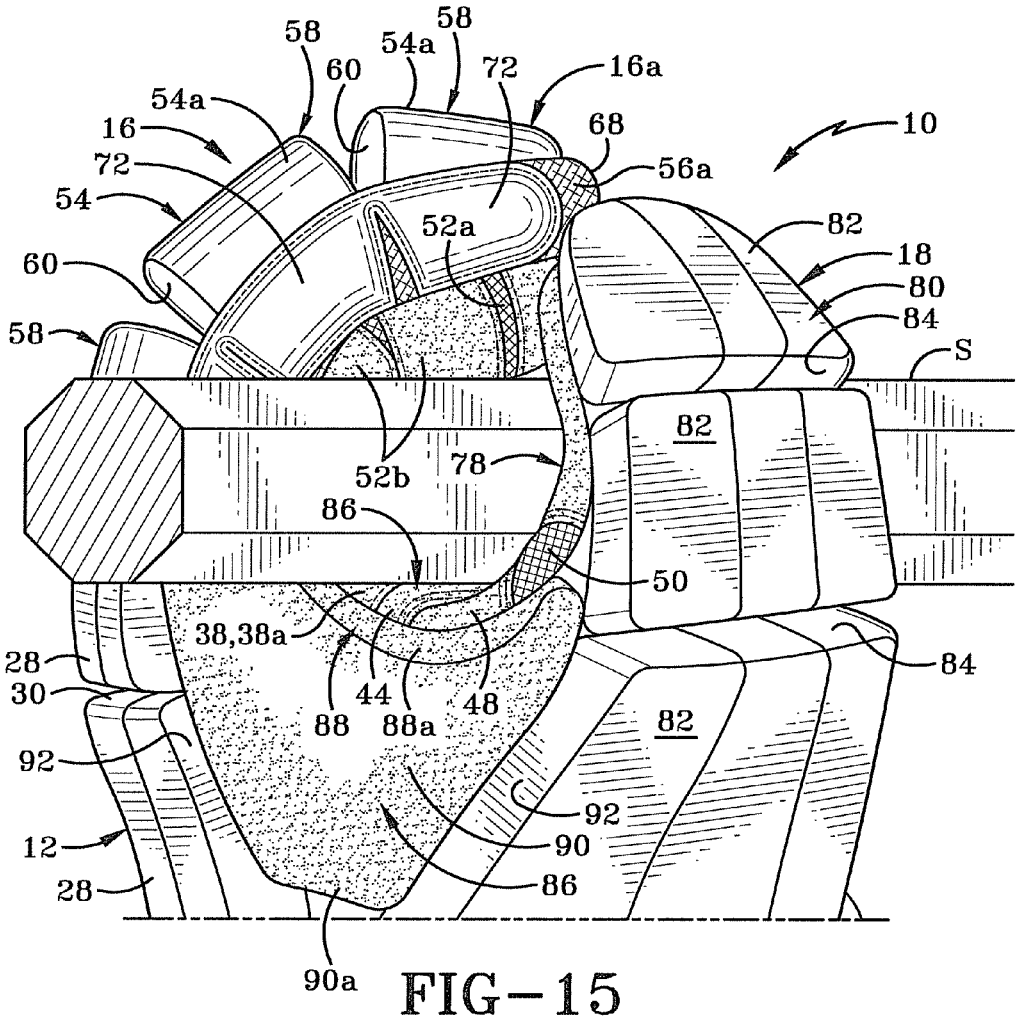
FIG. 15 is a right side perspective view of the glove being used to grasp the stick handle and showing the handle cradled on the top wall of the thumb crutch.

Top wall 88 resists the possible compression of sidewall 90 by stick "S". Additionally, the microfiber material utilized in thumb crotch 86 provides improved gripping characteristics relative to those that would be possible if the thumb crotch were manufactured from a material such as leather. As is best seen in FIG. 15, the curvature of first end 88 of thumb crotch 86 is designed so that it will enable the player to cradle the handle of stick "S". Furthermore, the rigidity of top wall 88 aids in reducing the tendency of stick "S", when retained between palmer region 14 and finger members 16*a*-16*d*, to pivot in a direction toward sidewall.

Cuff portion 20 is comprised of at least one cuff member. In the embodiment shown in the attached figures, cuff portion 20 comprises a first cuff member 94, a second cuff member 96 and a third cuff member 98. One or more of cuff members 94, 96, 98 are fixedly secured to liner 34 and extend downwardly beyond the lower edges 12*a*, 14*a* of one or both of dorsal and palmer regions 12, 14. Cuff members 94, 96, 98 are provided to protect the player's wrist and forearm "W" (FIG. 3). First cuff member 94 and third cuff member 98 are both generally elliptical in shape and oriented generally at right angles to the longitudinal axis "Y" of glove 10. Second cuff member 96 is generally rectangular in shape. Third cuff member 98 is larger than first cuff member 94 which, in turn, is larger than second cuff member 96. Preferably, all of the corner regions of each of the first, second and third cuff members are rounded.

Each of the first, second and third cuff members 94, 96, 98 are similarly constructed. The following description relates to second cuff member 96, shown in FIG. 7, but applies equally to the first and third cuff members. Second cuff member 96 comprises a pad 100 (FIG. 7) which include a rigid, interior support and/or a shock absorbing material retained in a pocket. The exterior surface of the pocket is made from a durable material, such as leather, and the interior surface is made of a different material that is designed to be worn adjacent the skin. The exterior surface of the pocket forms the exterior surface 96*a* of second cuff member 96 and the interior surface of the pocket forms the interior surface 96*b* of second cuff member 96. Preferably, interior surface 96*b* is made of the same material as is used for liner 34. A border 96*c* extends around substantially the entire peripheral edge of second cuff member 96. Border 96*c* is made from a third material such as a cotton fabric that will resist chaffing on the player's skin when cuff portion 20 is secured around their forearm. Second cuff member 96 has a first edge 96*d*, a second edge 96*e*, a first side 96*f* and a second edge 96*g*. Referring to FIG. 6 it can be seen that first side 96*f* originates generally along a midline of dorsal region 12, where the midline passes generally through valley 30*a*. Second side 96*g* is disposed substantially aligned with second side 10*b* of glove.

First cuff member 94 has an exterior surface 94*a*, an interior surface 94*b*, (FIG. 3), a border 94*c*, a first edge 94*d*, a second edge 94*e*, a first side 94*f* and a second side 94*g*. The width of first cuff member 94, as measured between first and second edges 94*d*, 94*e* is greater proximate second side 94*g* than proximate first side 94*f*, and the first and second side edges are gently curved from proximate second side 94*g* to first side 94*f*. First cuff member 94 extends laterally from proximate the midline on dorsal region 12, around first side 10*a* of glove 10 and for a distance along palmer region 14. As shown in FIG. 6, at least a portion of second side 94*g* of first cuff member 94 overlaps at least a portion of first side 96*f* of second cuff member 96. First cuff member 94 terminates proximate a middle region of palmer cuff 40 on palmer region 14 of glove. At least one aperture 102 is provided proximate first side 94*f*.

Third cuff member 98 has an exterior surface 98*a*, an interior surface 98*b* (FIG. 4), a border 98*c*, a first edge 98*d*, a second edge 98*e*, a first side 98*f* and a second side 98*g*. Third cuff member 98 originates proximate second side 10*b* of glove and extends for a distance under thumb portion 18 and along palmer region 14. Third cuff member 98 is wider, as measured from first edge 98*d* to second edge 98*e*, proximate first side 98*f* than proximate second side 98*g*. First and second edges 98*d* and 98*e* taper in a curved fashion from proximate first side 98*f* to proximate second side 98*g*. As shown in FIG. 6, at least a portion of first side 98*f* of third cuff member 98 overlaps at least a portion of second side 96*g* of second cuff member 96. A portion of third cuff member 98 adjacent second side 98*g* thereof overlaps a portion of first side 94*f* of first cuff member 94. At least one aperture 102 is provided proximate second side 98*g* of third cuff member 98. Neither of first and third cuff members 94, 98 are secured to palmer region 14 or to palmer cuff 40 and, consequently, a gap 104 (FIG. 3) exists between palmer cuff 40 and first and third cuff member 94, 98. Gap 104 permits air to freely enter and exit opening 26 into cavity 24.

In accordance with a specific feature of the present invention, a portion of first cuff member 94 and a portion of third cuff member 98 are secured to liner 34 by any suitable method, such as stitching. Preferably, the securement between first and third cuff member 94, 98 and liner 34 is a non-elastic connection. Second cuff member 96 preferably is secured to liner 34 by a strap 106 (FIG. 6). Strap 106 may be manufactured from an elastic material or from a non-elastic material. Alternatively, second cuff member 96 may be secured directly to liner 34 and the strap 106 may be omitted altogether. Additionally, first side 96*f* of second cuff member 96 is secured to second side 94*g* of first cuff member 96 and second side 96*g* of second cuff member 96 is secured to first side 98*f* of third cuff member 98. In an alternative arrangement (not shown), cuff members 94, 96 and 98 may each be connected to liner 34 and be free of attachments to each other. In this latter instance, the adjacently disposed cuff members will also partially overlap each other to ensure that the player's wrist "W" and forearm is adequately protected by them. A lace 108 (FIG. 3) is threaded through apertures 102 to secure first and third cuff members 94, 98 together. An adjustable locking member 110 is provided lock lace 108 in place.

In accordance with yet another feature of the present invention, the rounded edges of borders 94*c*, 96*c* and 98*c* cause a pair of vent openings 112 (FIG. 6) to be formed between adjacent cuff members. Opening 108 permit air to circulate into cavity 24 but are positioned in a location that reduces the possibility that water will flow into cavity 24 if it is raining, for example.

In accordance with yet another specific feature of the present invention, wrist guard 22 is provided to cover and protect the junction between dorsal region 12 and cuff portion 20. Wrist guard 22 comprises a primary member 114 and a secondary member 116. Each of the primary and secondary members 114, 116 are oriented generally horizontally with respect to the longitudinal axis "Y". Furthermore, members 114, 116 are disposed adjacent each other along the longitudinal axis "Y". Primary and secondary members 114, 116 are constructed in a similar fashion to cuff members 94, 96, 98 and include a rigid support with a pad of shock absorbing material enclosed in a pocket. The exterior surface of that pocket is made from a durable material such as leather. The interior surface thereof that abuts dorsal region 12 and cuff portion 20 may be made of any type of fabric material but especially one that will permit primary and secondary members 114, 116 to slide along the exterior surfaces of dorsal region 12 and cuff portion 20.

Primary member 114 has a first edge 114*a*, a second edge 114*b* a first side 114*c* (FIG. 3), a second side 114*d* (FIG. 4), a front wall 114*e* (FIG. 7) and a back wall 114*f*. First edge 114*a* is disposed closest to finger portion 16 and second edge 114*b* is disposed remote from finger portion 16. When viewed from the top, each of front wall 114*e* and back wall 114*f* are generally curved and C-shaped. First side 114*c* is connected by way of a connector 118 (FIG. 3) to a front area of one or more of thumb portion 18 and palmer region 14. Connector 118 may be a strap, tab, cord or any other suitable device that will permit primary member 114 to pivot or twist relative to and/or slide for a short distance along the outer surface of dorsal region 12. Preferably, connector 118 is flexible connector such as an elastic strap. Primary member 114 extends horizontally across the lowermost end of dorsal region 12 and wraps around second side 10*b* of glove 10. Second side 114*d* of primary member 114 is connected by way of a connector 120 (FIG. 4) to first side 10*a* of glove 10. Preferably, an additional connector 122 (FIGS. 5 & 6) connects back wall 114*f* of primary member 114 to one of liner 34 and lower edge 12*a* of dorsal region 12. Connectors 120 and 122 preferably are similar in type and nature to connector 118. Connectors 118, 120,122 are the only connections between primary member 114 and the rest of glove 10 and these connectors permit primary member 114 to flex, pivot and slide vertically relative to dorsal region 12.

As shown in FIG. 1, and in accordance with the present invention, first edge 114*a* of primary member 114 is substantially straight and extends generally horizontally relative to longitudinal axis "Y". First edge 114*a* is substantially free of curves along its length. Second edge 114*b* of primary member 114 includes curves and is contoured such that the primary member 114 is of a substantially uniform width (measured between first and second edges 114*a*, 114*b*) from first side 114*c* to about midway across dorsal region 12. Then, the width of primary member 114 increases gradually until proximate the join between dorsal region 12 and palmer region 14 at second side 10*b* of glove. The width then narrows once again from that point to second side 114*d*. The width of primary member 114 at second side 114*d* is greater than the width thereof proximate first side 114*c*. It should also be noted that second edge 114*b* is convexly curved relative to first edge 114*a*, particularly in the region "B" shown in FIG. 2. This region "B" will be disposed over the player's wrist bone at the base of their thumb. Thus, primary member 114 adds extra padding and therefore protection for the player's wrist to that already provided by cuff member 98. When the player flexes their hand, connectors 118, 120 and 122 permit the primary member 114 to pivot and/or slide relative to dorsal region 12. Thus, primary member 114 moves with the glove to ensure that it is able to generally remain over the area of the player's wrist "W" and thus effectively remain in a position where it protects the wrist bone.

Figure 4:
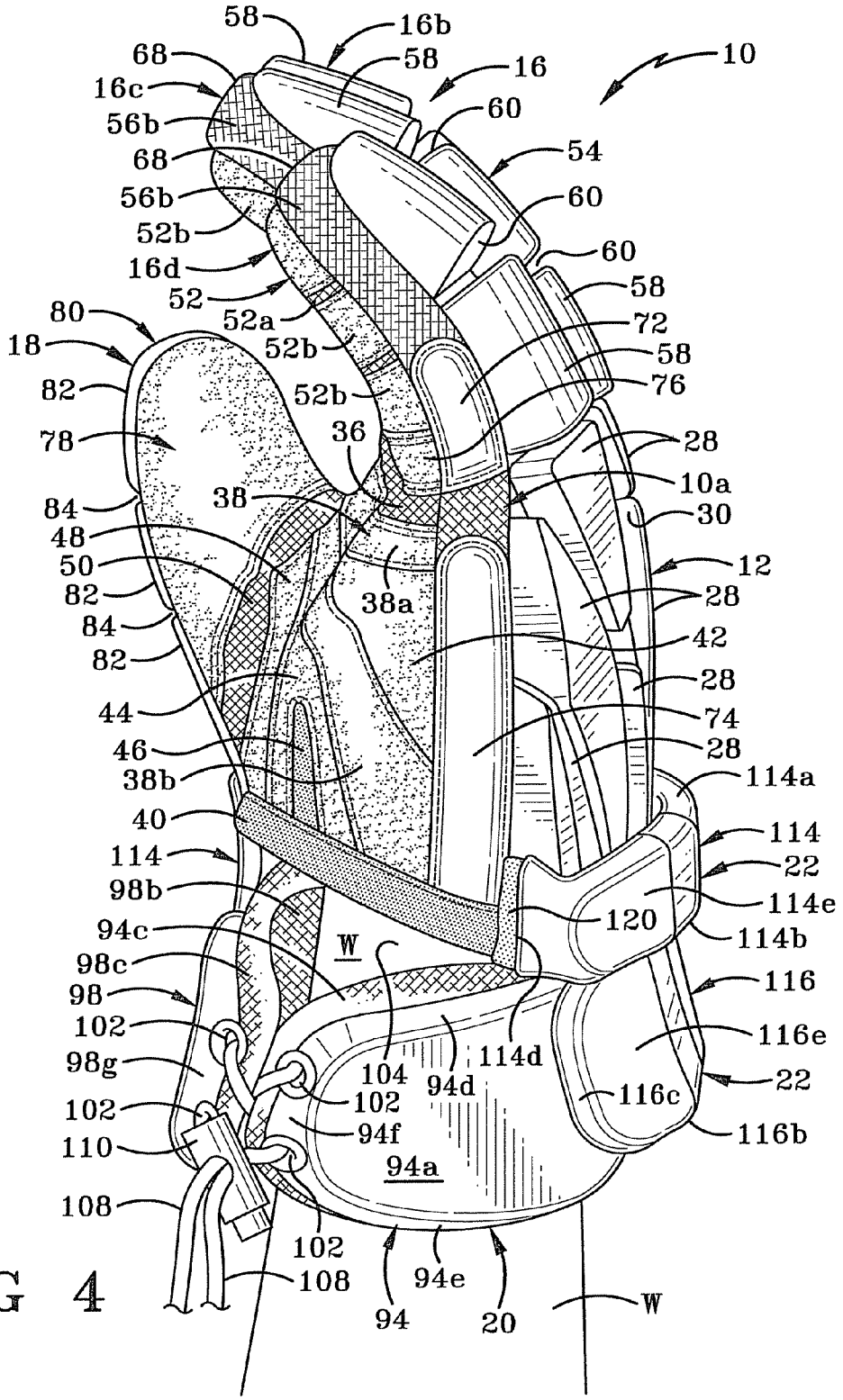
FIG. 4 is a left side view of the glove.
Figure 5:
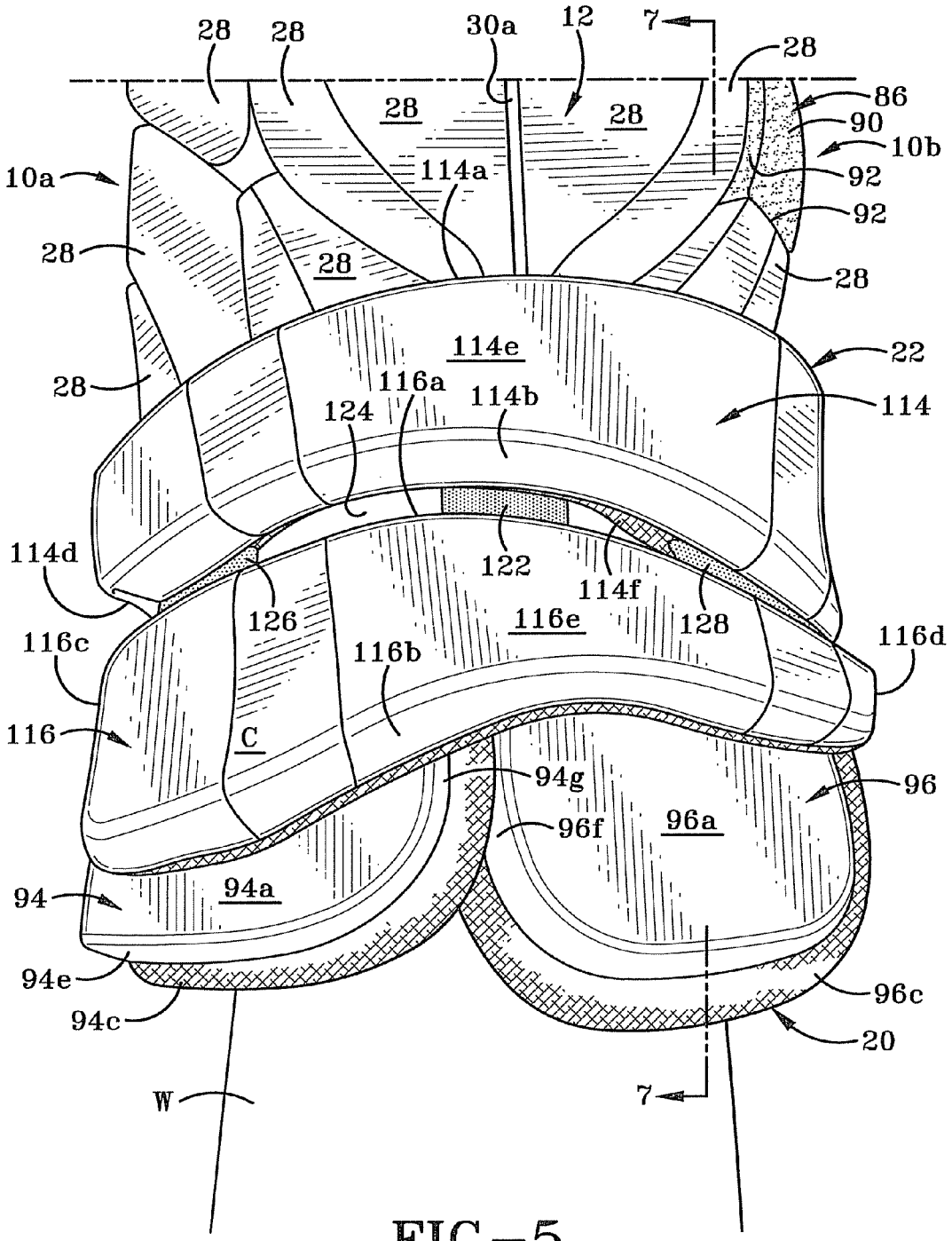
FIG. 5 is an enlarged rear view of the bottom end of the glove showing the cuff member and the primary and secondary members of the wrist guard.

As shown in FIGS. 4, 5 & 7, secondary member 116 has a first edge 116*a*, a second edge 116*b*, a first side 116*c*, a second side 116*d*, a front wall 116*e* and a back wall 116*f*. When viewed from the top, back wall 116*f* is generally curved and is C-shaped, being generally complementary in curvature to back wall 114*f* of primary member 114.

First edge 116*a* of secondary member 116 is contoured generally complementary to second edge 114*b* of primary member 114 but is positioned so that an aperture 124 (FIG. 5) is defined between second edge 114*b* and first edge 116*a* of primary and secondary members 114, 116. This aperture 124 permits air to flow freely into the cavity 24 of glove as it is positioned proximate vent openings 112. Second edge 116*b* of secondary member 116 is contoured in a manner opposite to second edge 114*b* of primary member 114. Consequently, secondary member 116 is narrower proximate second side 10*b* of glove and is widest proximate first side 10*a* thereof. Preferably, second edge 116*b* is slightly concavely contoured proximate second side 116*d* so as to permit the player to flex their wrist more easily. The width of secondary member 116 as measured between first and second edges 116*a*, 116*b* is greatest in the area "C" (FIGS. 1 & 5) and this additional width ensures that the wrist bone of the player adjacent the little finger side of the hand is adequately protected during play.

A pair of connectors 126 (FIG. 5) and 128 (FIG. 7) connect secondary member 116 to primary member 114. Connectors 126, 128 are of any type or material that will permit them to flex, pivot, twist or slide. A suitable material for connectors 126, 128 is an elastic strap. Connectors 126, 128 are spaced a distance horizontally apart from each other and define the outer edges of aperture 124. There are no other connections between secondary member 116 and any other parts of glove 10 and secondary member 116 is therefore free to pivot and move as the player moves their wrist and flexes their hand.

Primary member 114 is pivotable about a horizontal axis disposed at right angles to the longitudinal axis "Y" of glove 10. When primary member 114 pivots about this horizontal axis and rotates toward finger portion 16, primary member 114 imparts translational movement to secondary member 116, and secondary member 116 slides vertically toward finger portion 16. Similarly, when primary member 114 rotates in the opposite direction, it imparts translation motion to secondary member 116 and secondary member 116 slides away from finger portion 16. In a similar fashion, if secondary member 116 pivots toward finger portion 16 when the player flexes their hand, secondary member 116 will impart translation motion to primary member 114 and the primary member will slide vertically toward finger portion 16. When secondary member 116 pivots or rotates in the opposite direction, primary member 114 is caused to slide away from finger portion 16. Additionally, the translational movement of primary member 114 may also cause primary member 114 to rotate about the horizontal axis. Dorsal region 12 limits the degree of rotation of the primary member 114 and, in turn, primary member 114 limits the degree of rotation of secondary member 116.

The provision of the two members of the wrist guard 22 is advantageous in that it provides an additional layer of protection to a larger region of the player's wrist and forearm "W" than many previously known wrist guards but, at the same, time, does not limit the flexibility and mobility of the player's hand. The improved flexibility comes from the type of attachments between the primary and secondary members 114, 116, the fact that only the primary member 114 is connected to the hand portion of the glove, and the fact the two components are able to move relative to each other, i.e. that the wrist guard articulates.

Figure 11:
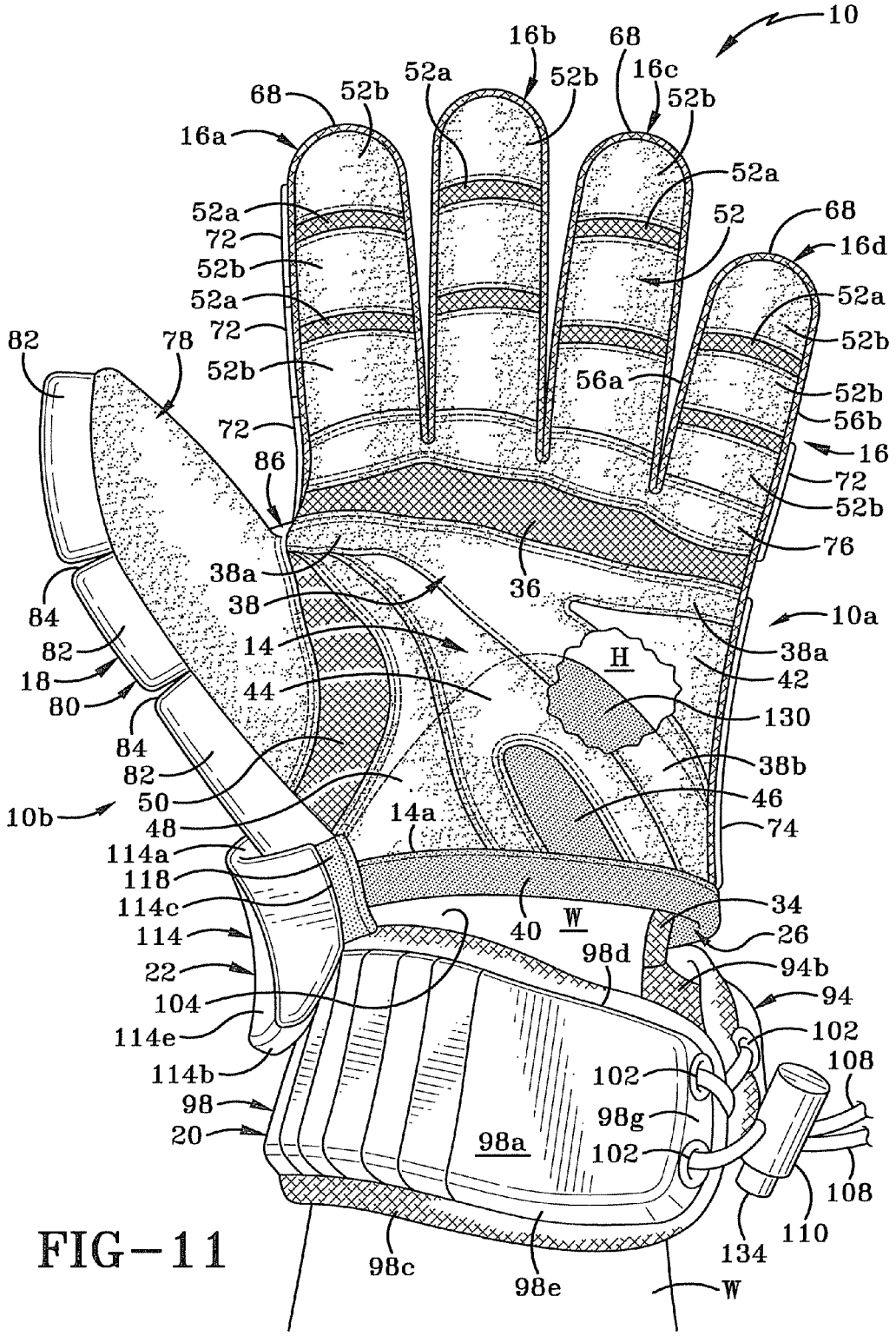
FIG. 11 is a front view of the glove showing a second embodiment of the palmer region including, in phantom, an elastic layer that is disposed inwardly behind the palmer region, and showing a portion of the elastic layer in the cut-away.
Figure 12:
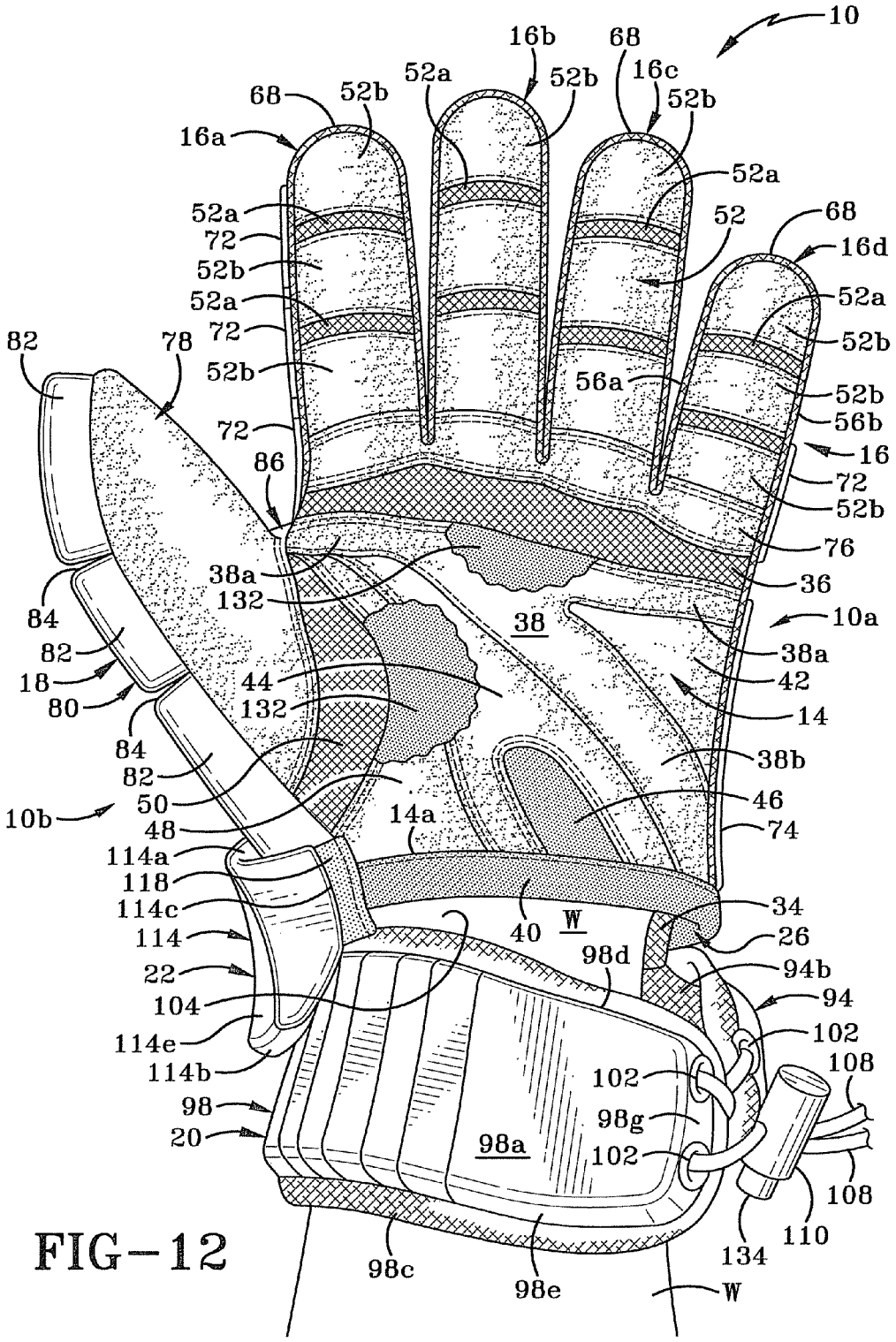
FIG. 12 is a front view of the glove showing a third embodiment of the palmer region where the elastic layer is shown in the two cut-aways.

FIGS. 11 and 12 show two alternative embodiments of palmer region 14 to the first embodiment that was represented in FIG. 3. FIG. 11 illustrates a second embodiment which includes the provision of a generally D-shaped elastic region 130 shown in phantom as extending as an inner layer disposed beneath parts of sixth area 48, fourth area 44, second area 38 and all of fifth area 46. The leading edge of elastic region 130 is shown in the cut-aways in FIG. 11. Elastic region 130 extends inwardly from palmer cuff 40 toward finger portion 16 and the leading edge thereof terminates approximately at a mid-point between the upper and lower edges of palmer region 14.

Elastic palmer cuff 40 is secured to elastic region 130 and may be integrally formed therewith. Elastic region 130 forms an inner layer of palmer region 14 and is secured to thumb portion 18 and dorsal region 12. The microfiber fabric used to construct sixth area 48, fourth area 44, and second area 38 form an outer layer of palmer region 14. The inner and outer layers preferably are secured together by a suitable means, such as stitching. Elastic region 130, including palmer cuff 40, at least partially bound and define a first region of cavity 24 together with a portion of dorsal region 12. A second region of cavity 24 remote from palmer cuff 40 and adjacent finger portion 16 is not bounded by elastic region 130 and is substantially non-elastic. The second region of cavity 24 is larger than the first region thereof when elastic region 130 is in a relaxed state, i.e., when the glove 10 is ready to receive a player's hand therein. The first region of cavity 24 expands when the player inserts their hand "H" into glove 10 because of the expansion of elastic region 130. The first region of cavity 24 reverts to substantially its original size once glove 10 is on the hand "H". The shrinking of elastic region 130 back to its original size aids in keeping glove 10 on hand "H".

FIG. 12 shows a third embodiment of the palmer region 14. In this instance, an elastic region 132 forms an inner layer of palmer region 114 and extends inwardly from palmer cuff 40 toward finger portion 16 and underneath substantially all of the microfiber material used in second area 38, third area 42, fourth area 44, and sixth area 48. Elastic region 132 terminates substantially along a second edge of first area 36 and along a side edge of seventh area 50. Only first area 36 and seventh area 50 are devoid of the elastic material. The fifth area 46 lacks the outer layer of microfiber material. The two cut-aways in FIG. 12 show the extent of the elastic region 132. Once again, elastic region 132 makes glove 10 stretchable and more flexible and therefore easier to put on and take off. Elastic region 132 also helps in keeping glove more snugly seated around the player's hand.

Figure 13:
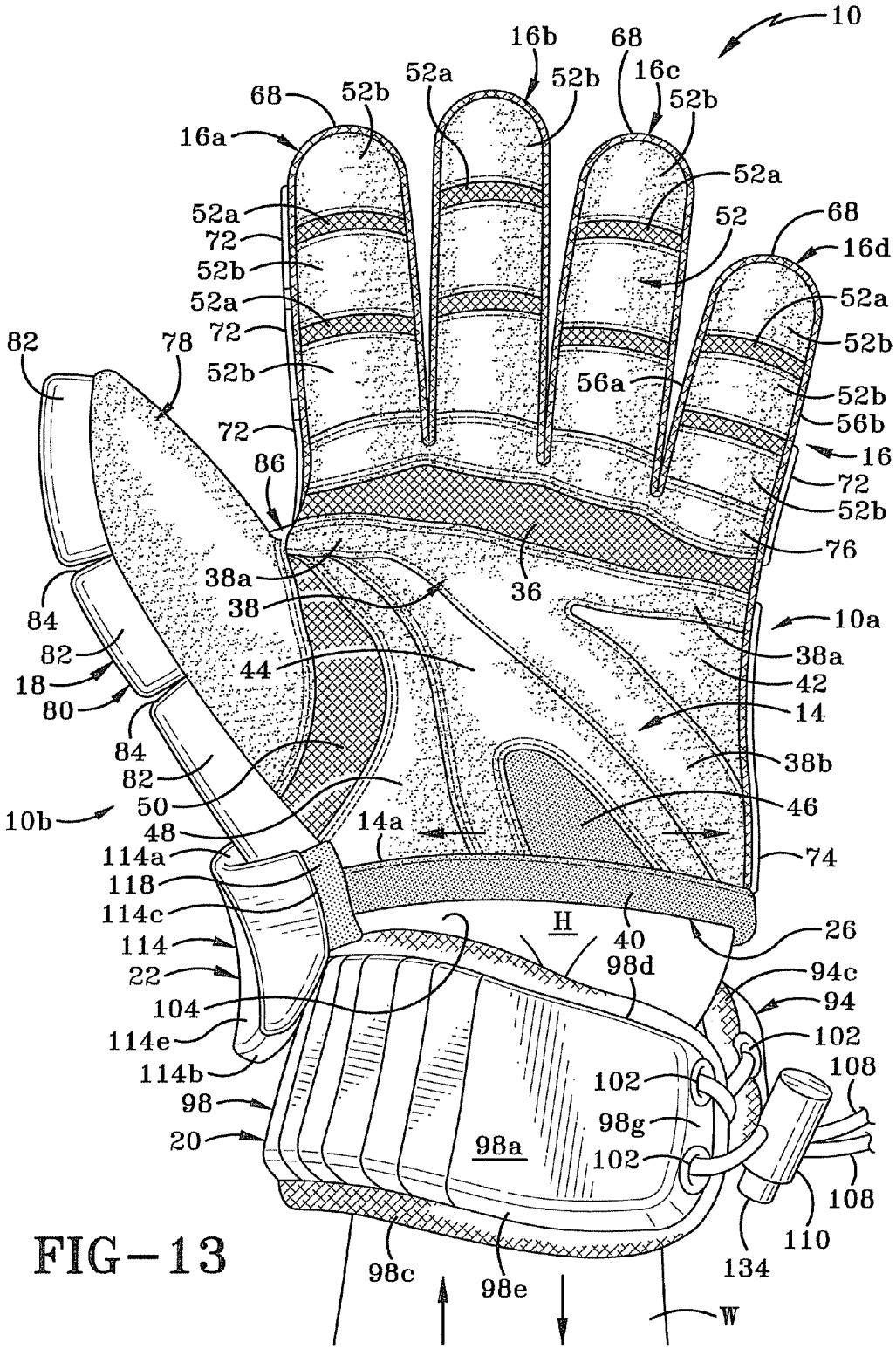
FIG. 13 is a front view of the glove showing the expansion of the palmer region when the glove is put onto or taken off of the player's hand.
Figure 14:
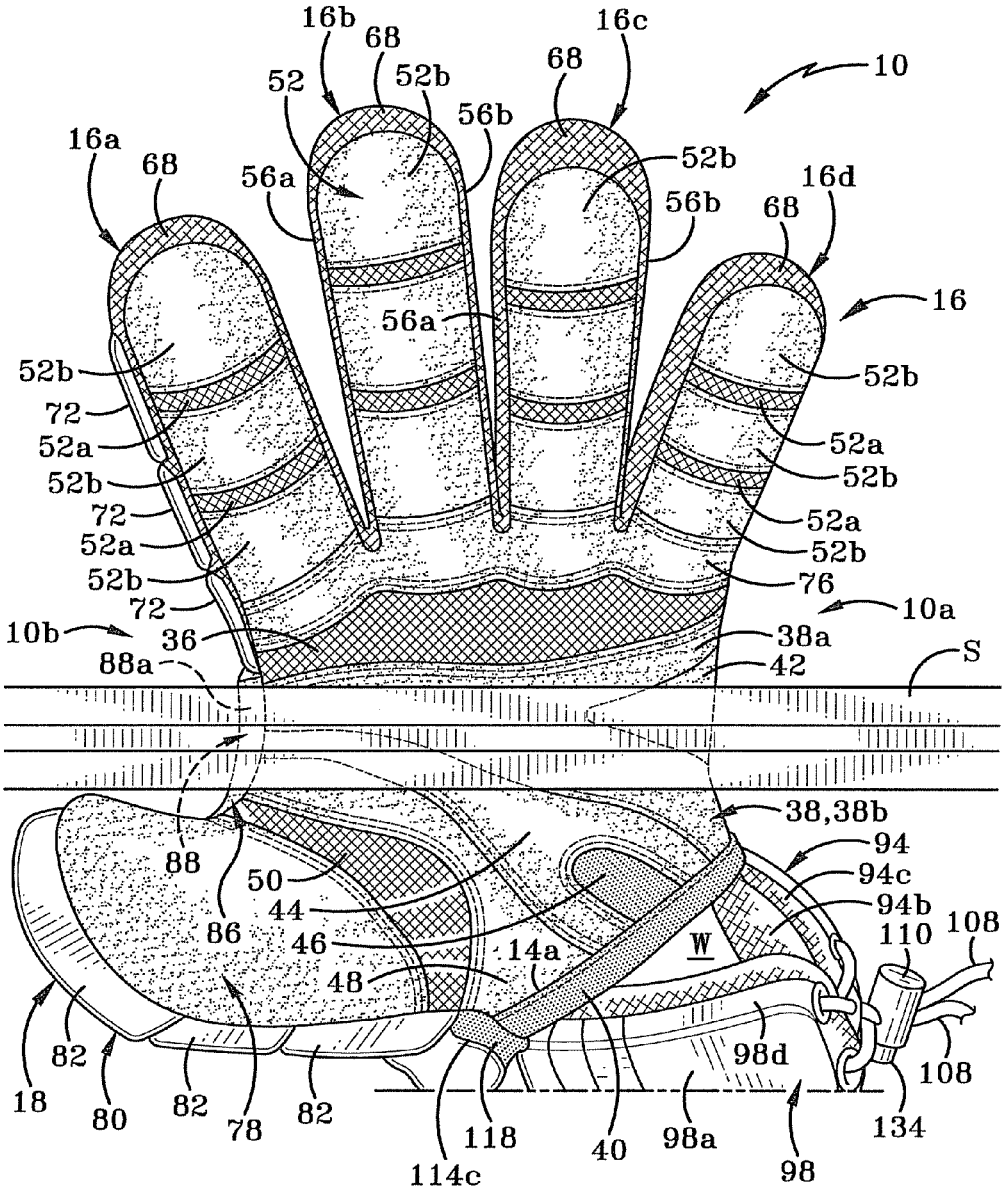
FIG. 14 is a top perspective view of the glove being used to grasp a lacrosse stick handle, illustrating how the stick is cradled in a thumb crotch and is supported on specific areas of the palmer region that are made from a material having a higher coefficient of friction than the surrounding areas.

Referring to FIGS. 13-15, glove 10 is used in the following manner. Prior to insertion of the player's hand "H" into glove 10, the glove is in a relaxed condition and, in particular, the lower edge of palmer region 14 is in a relaxed condition. The length "L" is at an initial size. The player inserts their hand "H" into glove 10 by inserting their fingers and thumb through opening 26, through the cavity (not shown in these figures) and into finger members **16*a*-16*d* and thumb portion 18. As the player inserts their hand through opening 26, the width of their hand initially forces fifth area 46 and palmer cuff 40, if provided, to stretch in the manner indicated by the arrows in FIG. 13. If elastic regions 130 or 132 are provided, they too will stretch and expand in the manner indicated by the arrows. This stretching motion increases the width "D" of fifth area 46 and length "L" of the lower edge of palmer region 14, therefore making it easier for hand "H" to slide into cavity 24. When hand "H" is stretching fifth area 46 and palmer cuff 40, the glove and the lower edge of palmer region 14 are in the expanded condition and length "L" is at its maximum size. Once hand "H" is inside glove 10, the lower edge of palmer region 14 is positioned adjacent the player's wrist "W". Since the player's wrist "W" is narrower than their hand "H", glove 10 is once again in a relaxed condition and fifth area 46 and palmer cuff 40 decreases to their initial size. Thus, length "L" of lower edge of palmer region 14** is decreased to its initial size.

It should be noted that the provision of fifth area 46 assists greatly in permitting the player to insert their hand "H" into the glove. If only palmer cuff 40 was made from an elastic material, only the palmer cuff itself would stretch and increase in length. The rest of palmer region 14 would not stretch as it is made from a non-stretchable or non-elastic microfiber material. Fifth area 46 extends for a distance of about one third of the way between the upper and lower edges of palmer region 14. Fifth area 46 therefore allows for about the lower one third of palmer region 14 to increase in width. Additionally, there is a greater width of elastic fabric in the bottom end of fifth area 46 proximate lower edge **14*a* than there is at the apex of the fifth area. Consequently, the bottom end of fifth area 46 permits the lower end 14*a* of palmer region 14** to stretch to the greatest extent, making it much easier for the player to insert their hand into the glove or remove it therefrom.

The player then tightens lace 108 so that first and third cuff members 94, 98 are drawn together around their wrist and forearm "W". The player depresses button 134 on locking member 110 and slides locking member 110 toward cuff members 94, 98 to lock lace 108 in place.

The player then grasps the handle "S" of their sporting implement, in this instance a lacrosse stick. As shown in FIG. 14, the handle "S" of the stick is cradled in the curved top wall 88 of thumb crotch 86 and rests on the areas of palmer region 14 that are made from microfiber fabric, namely, second area 38, third area 42, portions of fourth area 44 and portions of sixth area 48. The player closes their fingers and thumb around stick "S". The microfiber areas in palmer region 14, the inner portions 52 of finger members **16*a*-16*d*, and inner portion 78 of thumb portion 18 and top wall 88 of thumb crotch 66 help the player grip stick "S" and aid in preventing rotational motion of stick "S" when so held. It should also be noted from FIG. 14 that when the player is grasping stick "S", the two regions of breathable fabric, namely first area 36 and seventh area 50 are not covered by the stick, thus leaving these areas open for air to flow into and out of cavity 24. The rigidity of top wall 88 of thumb crotch 86 also aids in preventing the side wall 90 of the thumb crotch 86 from being crushed by pressure brought to bear upon it by stick "S" and at the same time aid the player in holding the stick in the optimum position for playing the game. Top wall 88 and sidewall 90 of thumb crotch 86 maintain an angle between thumb crotch 86 and stick "S" in a first direction and finger members 16*a*-16*d* and thumb portion 18 maintain an angle between thumb crotch 86** and stick "S" in a second direction.

As the player flexes their hand "H" and wrist "W" during play, the first and second guard portions 114, 116 move relative to dorsal region 12 and relative to each other as previously described herein and thus aid in providing substantially continuous protection to the player's hand and wrist. The pads 28, 58 and 82 provide protection for the back of the player's hand from impacts with other player's sticks.

When the player wishes to remove the glove 10, they depress button 134 on locking device 110 and slide device 110 along lace 108 until a sufficient gap opens up to permit first and third cuff members 94, 98 to separate from each other. The player grasps palmer cuff 40 and pulling it outwardly to stretch the elastic material in palmer cuff 40 and fifth area 46, and elastic regions 130 and 132 if provided, outwardly as indicated by the arrows in FIG. 13. The player then slides their hand out of the glove.

Accordingly, the glove of the present invention is an effective, safe, inexpensive, and efficient device that achieves all the enumerated objectives of the invention, provides for eliminating difficulties encountered with prior art devices, systems, and methods, and solves problems and obtains new results in the art.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

Having now described the features discoveries, and principles of the invention, the manner in which the glove is construed and used, the characteristics of the construction, and the advantageous new and useful results obtained; the new and useful structures, devices, elements, arrangement, parts, and combinations are set forth in the appended claims.

The invention claimed is:

1. A glove comprising:

a hand portion having a palmer region and a dorsal region; and a finger portion extending outwardly from the hand portion, wherein the finger portion comprises a first finger member having an inner portion, a dorsal portion, and a sidewall that extends between the inner portion and the dorsal portion, wherein the inner portion, dorsal portion, and sidewall define a finger cavity therebetween, the dorsal portion including an inner pad layer and an outer pad layer, the inner pad layer and outer pad layer spaced from one another, wherein the inner portion of the first finger member comprises at least two exterior frictionally engaging surfaces and a mesh portion disposed between the two frictionally engaging surfaces, wherein the at least two exterior frictionally engaging surfaces are entirely discrete from each other.

2. The glove of claim 1, wherein the sidewall is spaced a substantially equal distance from each of the inner portion and dorsal portion.

3. The glove of claim 1, wherein the dorsal portion includes at least one protective pad.

4. The glove of claim 1, wherein the sidewall is made from a material that permits air to flow into and out of the finger cavity.

5. The glove of claim 1, wherein the sidewall is straight and the inner portion is arcuate in shape when viewed from a tip of the first finger member when the glove is in a relaxed condition.

6. The glove of claim 1 wherein the inner portion extends arcuately away from the dorsal portion.

7. The glove of claim 1, wherein the frictionally engaging surfaces are made from a microfiber material.

8. The glove of claim 1, further comprising a second finger member, wherein the first finger member is adapted to receive the index finger of a hand therein and the second finger member is adapted to receive the little finger of the hand therein, wherein the construction of the second finger member is substantially identical to the construction of the first finger member, and wherein the glove further comprises a protective member disposed on an outside of the sidewall of at least one of the first and second finger members.

9. The glove of claim 8, wherein the sidewall of each of the first and second finger members is made from a breathable material, and wherein the protective member is made from a non-breathable material.

10. The glove of claim 9, wherein the protective member comprises at least two discrete pads secured as an exterior layer over an exterior surface of the breathable material.

11. The glove of claim 10, wherein the two discrete pads are separated from each other by a region of breathable fabric.

12. The glove of claim 1, further comprising a reinforcement member overlapping and connecting the palmer region to the finger portion.

13. The glove of claim 12, wherein the first finger member further comprises a tip having a semi-circular shape.

14. The glove of claim 13, wherein the reinforcement member is disposed proximate a base of the finger portion adjacent the palmer region and extending upwardly for a distance along the base of the finger portion and toward the tip of the first finger member.

15. The glove of claim 14, wherein the inner portion is curved toward the tip.

16. The glove of claim 1, wherein the dorsal region is generally straight when viewed from a tip of the first finger member.

17. The glove of claim 16, wherein the sidewall of the first finger member is generally straight and arranged perpendicular to the dorsal region when viewed from a tip of the first finger member.

18. The glove of claim 17, wherein the tip is arcuate and generally perpendicular to the arcuate inner portion.

19. The glove of claim 18, wherein the first radius and the second radius are substantially continuous.

20. The glove of claim 19, wherein the first radius and the second radius form an angle of approximately 180 degrees.

21. The glove of claim 1, wherein the first finger member further comprises a first radius between one of the pair of sidewalls and the inner portion and a second radius between the other of the pair of sidewalls and the inner portion.

22. The glove of claim 21, wherein the first radius and the second radius are the same.

23. The glove of claim 1, wherein the first finger member comprises a first seam disposed in the finger cavity, and wherein the first seam secures the inner portion to a first edge of the sidewall.

24. The glove of claim 23, wherein the first finger member comprises a second seam disposed in the finger cavity, and wherein the second seam secures the dorsal portion to a second edge of the sidewall.

25. The glove of claim 24, wherein the first seam is recessed relative to the palmer region such that the inner portion wraps around the sides of a wearer's finger inserted within the finger cavity.

26. The glove of claim 1, wherein the at least two frictionally engaging surfaces are stitched onto the mesh portion.

27. The glove of claim 1, wherein the frictionally engaging surfaces have higher coefficients of friction than the mesh portion.

28. The glove of claim 1, wherein the frictionally engaging surfaces have higher coefficients of friction than the dorsal portion.

29. A glove comprising:

a hand portion having a palmer region and a dorsal region; and a finger portion extending outwardly from the hand portion and comprising a first finger member having an inner portion, a dorsal portion, and a sidewall that extends between the inner portion and the dorsal portion, the dorsal portion including an inner pad layer and an outer pad layer, the inner pad layer and outer pad layer spaced from one another, wherein the inner portion, dorsal portion, and sidewall define a finger cavity therebetween, and wherein the inner portion at a cross-section viewed from the tip of the first finger portion defines a semi-circular surface having a first seam at opposite ends thereof, and wherein the first seam is disposed between the inner pad layer and outer pad layer.

30. The glove of claim 29, wherein the sidewall is breathable material, and wherein at least two discrete pads are disposed on the sidewall and comprise patches secured over the breathable material.

31. The glove of claim 29, wherein at least two discrete pads are disposed on the sidewall of the finger portion.

32. A glove comprising:

a hand portion having a palmer region and a dorsal region; and a finger portion extending outwardly from the hand portion, wherein the finger portion comprises a first finger member having an inner portion, a dorsal portion, and a sidewall that extends between the inner portion and the dorsal portion, wherein the inner portion, dorsal portion, and sidewall define a finger cavity therebetween, wherein the inner portion at a cross-section viewed from the tip of the first finger portion defines a semi-circular surface having a first seam at opposite ends thereof, and wherein the seam joins the inner portion and the sidewall and is disposed inwardly away from a palmer surface of the finger portion along the side of the finger portion, and between a first pad layer and a second pad layer.

33. The glove of claim 32, wherein the dorsal portion at the cross-section viewed from a tip of the first finger portion defines a flat surface and is joined to the sidewall by a second seam.

34. The glove of claim 32, wherein tangents of the semi-circular surface at the first seam are parallel to the sidewall, viewed from the tip of the first finger portion.

* * * * *